US011840063B2

(12) United States Patent
Yoda

(10) Patent No.: US 11,840,063 B2
(45) Date of Patent: Dec. 12, 2023

(54) RECORDING SYSTEM AND DRYING DEVICE

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/808,022

(22) Filed: Jun. 21, 2022

(65) Prior Publication Data

US 2022/0410593 A1 Dec. 29, 2022

(30) Foreign Application Priority Data

Jun. 24, 2021 (JP) ..... 2021-105142

(51) Int. Cl.
*B41J 11/00* (2006.01)

(52) U.S. Cl.
CPC ..... *B41J 11/0024* (2021.01); *B41J 11/007* (2013.01); *B41J 11/0022* (2021.01)

(58) Field of Classification Search
CPC ... B41J 11/0024; B41J 11/0022; B41J 11/007; B41J 11/00222; B41J 11/00242; B41J 2/01
See application file for complete search history.

(56) References Cited

U.S. PATENT DOCUMENTS

2019/0100034 A1* 4/2019 Yoda ..... B41J 11/00216

FOREIGN PATENT DOCUMENTS

JP 2019-064124 A 4/2019

* cited by examiner

*Primary Examiner* — Bradley W Thies
(74) *Attorney, Agent, or Firm* — WORKMAN NYDEGGER

(57) ABSTRACT

A recording system includes a recording device including a recording unit configured to perform recording, and a drying device including a drying mechanism. The recording device includes a support surface configured to support the recording medium and provided downstream of the recording unit in the conveyance direction, the device is configured to be mounted on the recording device at a position where the support surface and the drying mechanism face each other, one of the recording device and the drying device includes a setting member configured to set a spacing between the support surface and the drying mechanism to a predetermined spacing when the drying device is mounted on the recording device, the drying mechanism functions when the spacing is set to the predetermined spacing by the setting member, and a function of the drying mechanism stops when the setting by the setting member is released.

12 Claims, 11 Drawing Sheets

RECORDING SYSTEM AND DRYING DEVICE

The present application is based on, and claims priority from JP Application Serial Number 2021-105142, filed Jun. 24, 2021, the disclosure of which is hereby incorporated by reference herein in its entirety.

BACKGROUND

1. Technical Field

The present disclosure relates to a recording system including a recording device that performs recording by applying liquid to a recording medium and a drying device that dries a recording medium on which liquid is applied, and the drying device.

2. Related Art

The medium processing device disclosed in JP-A-2019-64124 includes a recording unit and a heating device. When the recording unit discharges liquid to a medium, an image is recorded on the medium. When the medium on which liquid is applied by the recording unit is heated by the heating device, the moisture of the liquid applied to the medium evaporates. The medium processing device is an example of a recording device, the heating device is an example of a drying device, and the medium is an example of a recording medium.

Some users of the recording device do not require the drying device. Therefore, it is conceivable to employ a configuration in which the drying device is an optional device that is mounted on the recording device so as not to put more than the necessary burden in terms of cost on the user who does not require the drying device. However, there is a risk that when the user mounts the drying device to the recording device, the drying device is not mounted in the state where the recording medium to be dried and the drying device are in an appropriate positional relationship, and consequently appropriate drying of the recording medium cannot be achieved.

SUMMARY

To solve the above-mentioned problems, a recording system includes a recording device and a drying device, the recording device including a recording unit configured to perform recording by applying liquid to a recording medium conveyed in a conveyance direction, the drying device including a drying mechanism configured to dry the recording medium to which the liquid is applied. the recording device includes a support surface configured to support the recording medium and provided downstream of the recording unit in the conveyance direction, the device is configured to be mounted on the recording device at a position where the support surface and the drying mechanism face each other, one of the recording device and the drying device includes a setting member configured to set a spacing between the support surface and the drying mechanism to a predetermined spacing when the drying device is mounted on the recording device, the drying mechanism functions when the spacing is set to the predetermined spacing by the setting member, and a function of the drying mechanism stops when the setting by the setting member is released.

To solve the above-mentioned problems, a drying device is configured to be mounted on a recording device, the recording device including a recording unit configured to perform recording by applying liquid to a recording medium conveyed in a conveyance direction, and a support surface configured to support the recording medium downstream in the conveyance direction, the drying device including a drying mechanism configured to dry the recording medium, to which the liquid is applied, at a position facing the support surface when the drying device is mounted on the recording device. The drying device includes a setting member configured to set a spacing between the support surface and the drying mechanism to a predetermined spacing, the drying mechanism functions when the spacing is set to the predetermined spacing by the setting member, and a function of the drying mechanism stops when the setting by the setting member is released.

DESCRIPTION OF EXEMPLARY EMBODIMENTS

Figure 1:
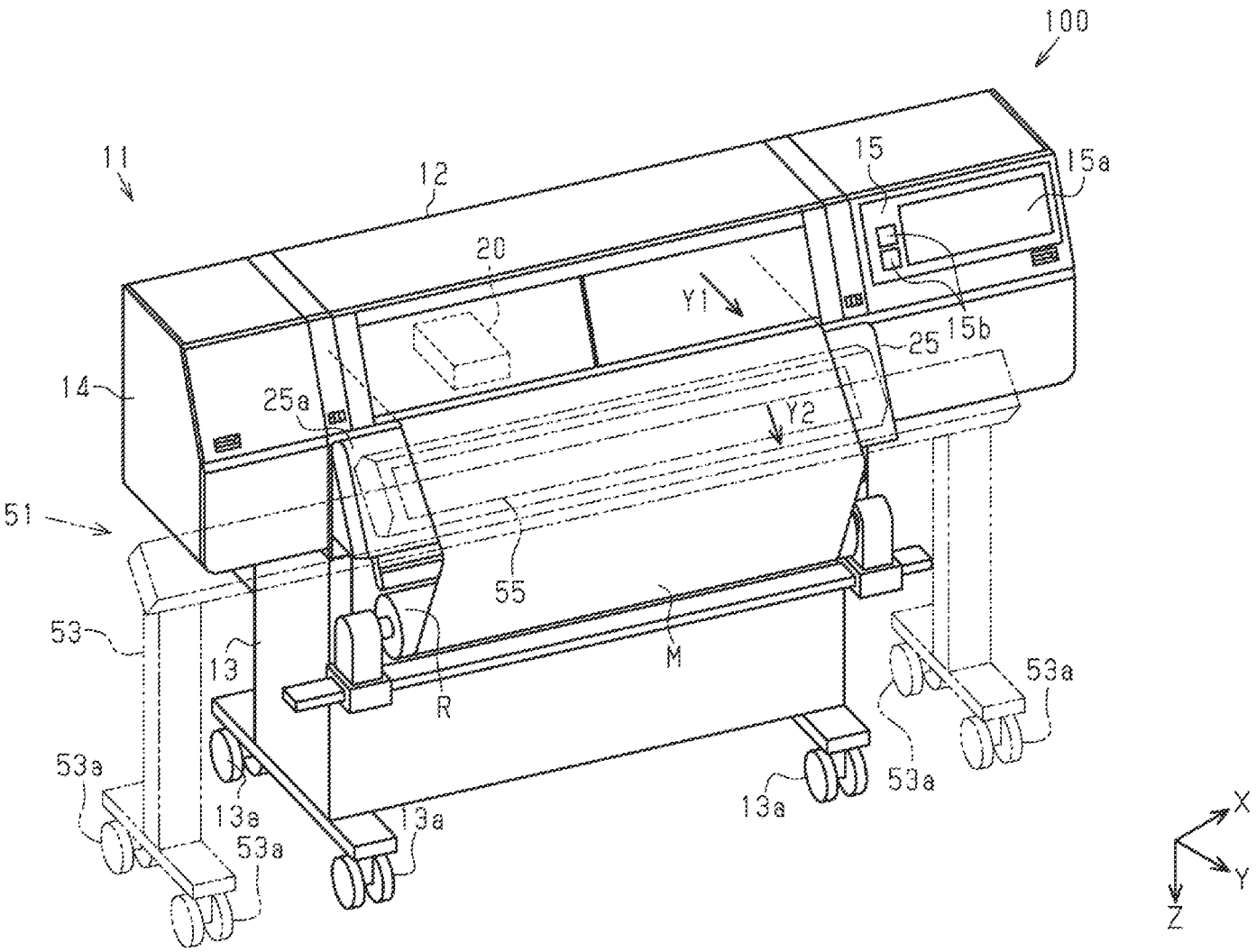
FIG. 1 is a perspective view illustrating a recording system according to first to third embodiments.

A recording system and a drying device according to first to third embodiments are described below with reference to the drawings. The recording system records letters and images on a recording medium such as a sheet by discharging ink as an example of liquid to the recording medium, and dries the recording medium to which the liquid is applied, by using a drying device, for example.

In the drawings, on the assumption that a recording system 100 is placed on a horizontal plane, the gravity direction is indicated as Z axis, and the directions along the horizontal plane are indicated as X axis and Y axis. The X axis, Y axis and Z axis are orthogonal to each other. In the following description, the direction along the X axis is also referred to as width direction X, the direction along the Y axis is also referred to as depth direction Y, and the direction along the Z axis is also referred to as vertical direction Z.

First Embodiment

Overview of Recording System

As illustrated in FIG. 1, the recording system 100 includes a recording device 11. The recording device 11 includes a recording unit 20 that performs recording on a recording medium M. The recording unit 20 applies liquid on the surface of the recording medium M by discharging the liquid to the recording medium M by using a liquid discharging head (not illustrated in the drawing) while moving back and forth along a guide shaft (not illustrated in the drawing) extending in the width direction X. That is, the recording unit 20 performs recording by applying liquid to the recording medium M conveyed in a conveyance direction Y1.

The recording device 11 includes a housing 12, a cover 14 that covers the housing 12, and an operation unit 15. The operation unit 15 includes, for example, an operation button 15*b*, a display unit 15*a* a composed of a touch-screen liquid crystal screen, and the like. The operation unit 15 is configured such that the user can confirm the entire status of the recording system 100 and operate it.

Figure 2:
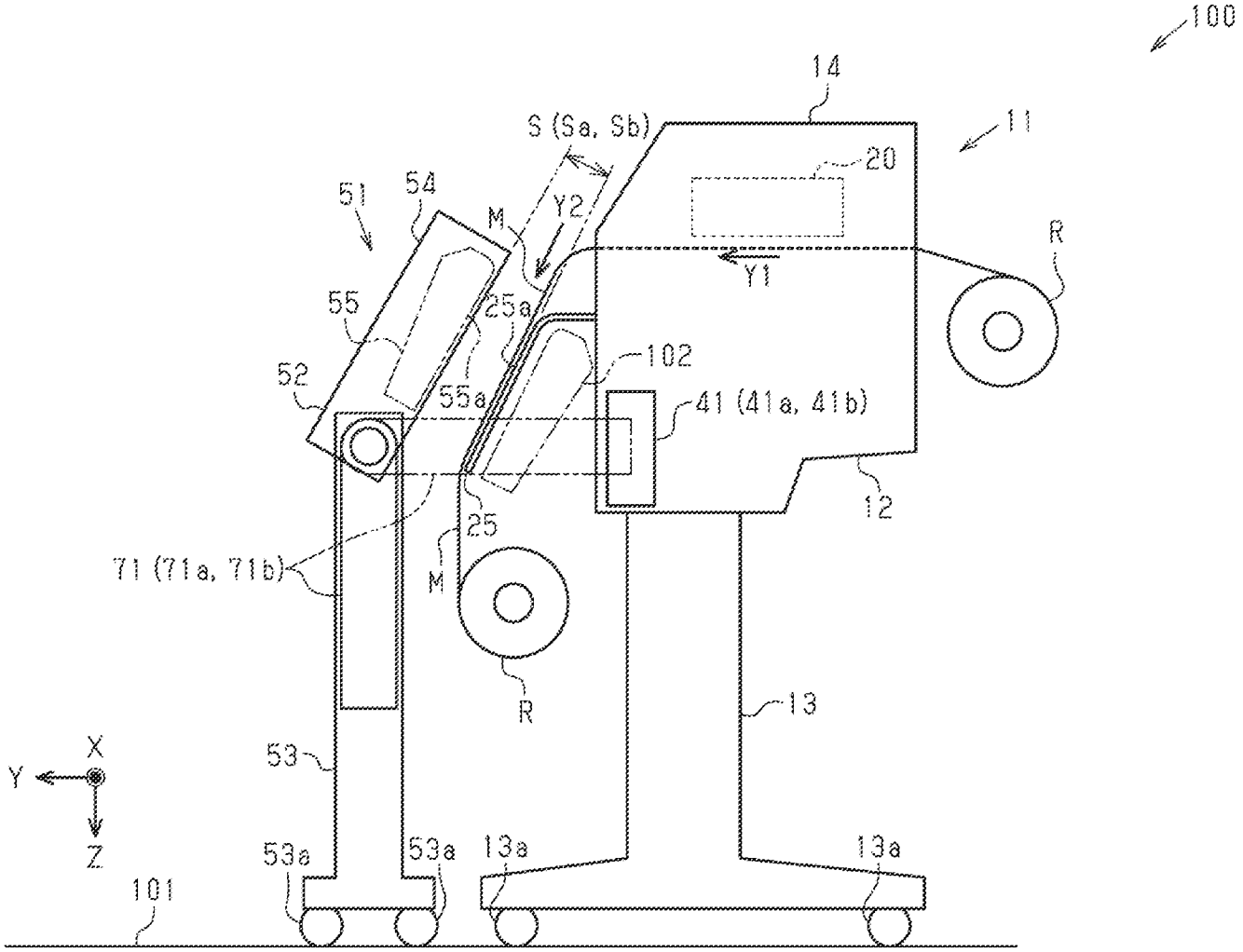
FIG. 2 is a schematic side view illustrating the recording system according to the first to third embodiments.

As illustrated in FIG. 2, the recording medium M is unrolled from a roll R, which is wound in a cylindrical form. Then, after recording is performed on the recording medium M, the recording medium M is wound in a cylindrical form as the roll R.

The recording device 11 includes a supporting unit 25 on the downstream side of the recording unit 20 in the conveyance direction Y1. The supporting unit 25 includes a support surface 25*a* that supports the recording medium M on which liquid is applied on the downstream side in the conveyance direction Y1. The support surface 25*a* is a surface that extends in a downward direction, which is a direction that intersects a floor surface 101. At the supporting unit 25, the recording medium M is conveyed in a second conveyance direction Y2 along the support surface 25*a*.

In this embodiment, since the conveyance direction of the recording medium M changes depending on the locations, the conveyance direction of the recording medium M at the recording unit 20 is referred to as the conveyance direction Y1, and the conveyance direction of the recording medium M at the support surface 25*a* is referred to as the second conveyance direction Y2. The conveyance direction Y1 and the second conveyance direction Y2 are the longitudinal direction of the recording medium M. The conveyance direction Y1 coincides with the depth direction Y of the recording system 100. Note that the width direction X is the width direction of the recording system 100 and is the width direction of the recording medium M.

The recording device 11 includes a leg part 13 that supports the housing 12. A plurality of casters 13*a* may be attached to the leg part 13. With the roller provided in the caster 13*a*, the recording device 11 is installed on the floor surface 101. The caster 13*a* may include a lock lever (not illustrated in the drawing). The rotation of the roller may be locked when the lock lever is operated. When the lock lever locks the roller, the position of the recording device 11 is fixed. When the lock is unlocked, the user can move the recording device 11.

The recording system 100 includes a drying device 51. The drying device 51 includes a housing 52, a leg part 53 that supports the housing 52, and a cover 54 that covers the housing 52. The drying device 51 includes a plurality of casters 53*a* at its leg part 53. With the roller provided in the caster 53*a*, the drying device 51 is installed on the floor surface 101. That is, the recording device 11 and the drying device 51 are installed on the same plane. The caster 53*a* may include a lock lever (not illustrated in the drawing). The rotation of the roller may be locked when the lock lever is operated. When the lock lever locks the roller, the position of the drying device 51 is fixed. When the lock lever is unlocked, the user can move the drying device 51.

The drying device 51 includes, at a position opposite to the support surface 25*a*, a drying mechanism 55 that dries the recording medium M on which liquid is applied. The drying device 51 is configured to be mounted on the recording device 11 at a position where the support surface 25*a* and the drying mechanism 55 face each other. Since the support surface 25*a* supports the recording medium M on which liquid is applied, the surface of the recording medium M and the drying mechanism 55 face each other when the drying device 51 is mounted on the recording device 11. In this state, the drying device 51 dries the recording medium M on which liquid is applied by the recording unit 20 by heating the surface of the recording medium M by using the drying mechanism 55, and as a result the moisture of the liquid adhered on the recording medium M evaporates. In this manner, the recording medium M on which liquid is applied is dried.

The drying mechanism 55 is disposed in the housing 52. The drying mechanism 55 includes a heat dissipation surface 55*a* in the direction of heat emission. Among surfaces making up the exterior of the drying mechanism 55, the surfaces other than the heat dissipation surface 55*a* are covered with the cover 54 so that they cannot be touched by the user.

The leg part 53 supports the housing 52 such that the angle of the heat dissipation surface 55*a* with respect to the floor surface 101 is the same as the angle of the support surface 25*a* with respect to the floor surface 101. The drying mechanism 55 may be configured such that the angle of the heat dissipation surface 55*a* with respect to the floor surface 101 can be adjusted so that the drying device 51 can be used also for the recording device 11 whose support surface 25*a* has a different angle with respect to the floor surface 101. In addition, the drying mechanism 55 may be configured such that the height of the heat dissipation surface 55*a* with respect to the floor surface 101 can be adjusted so that the drying device 51 can be used also for the recording device 11 whose support surface 25*a* has a different height with respect to the floor surface 101.

Note that a second drying mechanism 102 may be provided on the rear side of the supporting unit 25. The second drying mechanism 102 may be disposed in a housing (not illustrated in the drawing) of a second drying device, and the second drying device, together with the drying device 51, may be mounted on the recording device 11.

Setting Member

As illustrated in FIG. 2, one of the recording device 11 and the drying device 51 includes a setting member 71 that sets a spacing S between the support surface 25*a* and the drying mechanism 55 to a predetermined spacing when the drying device 51 is mounted on the recording device 11. More correctly, the spacing S is a spacing between the heat dissipation surface 55*a* and the support surface 25*a*. When the drying device 51 moves the floor surface 101, which is an installation surface, the drying device 51 is mounted on the recording device 11 from a direction parallel to the floor surface 101.

In addition, when the drying device 51 is mounted on the recording device 11, the setting member 71 sets the position of the drying device 51 with respect to the recording device 11. More specifically, the setting member 71 sets the position of the drying mechanism 55 in the second conveyance direction Y2 to a predetermined position, on the support surface 25*a*.

The setting member 71 is configured such that the posture is switchable between a first posture indicated by the chain double-dashed line in FIG. 2 where the spacing S is set to a predetermined spacing, and a second posture indicated by the solid line in FIG. 2 where the footprint at the setting member 71 is smaller than in the first posture.

The setting member 71 can switch the posture between the first posture and the second posture when the setting member 71 turns around its one end axially supported by one of the recording device 11 and the drying device 51.

Figure 3:
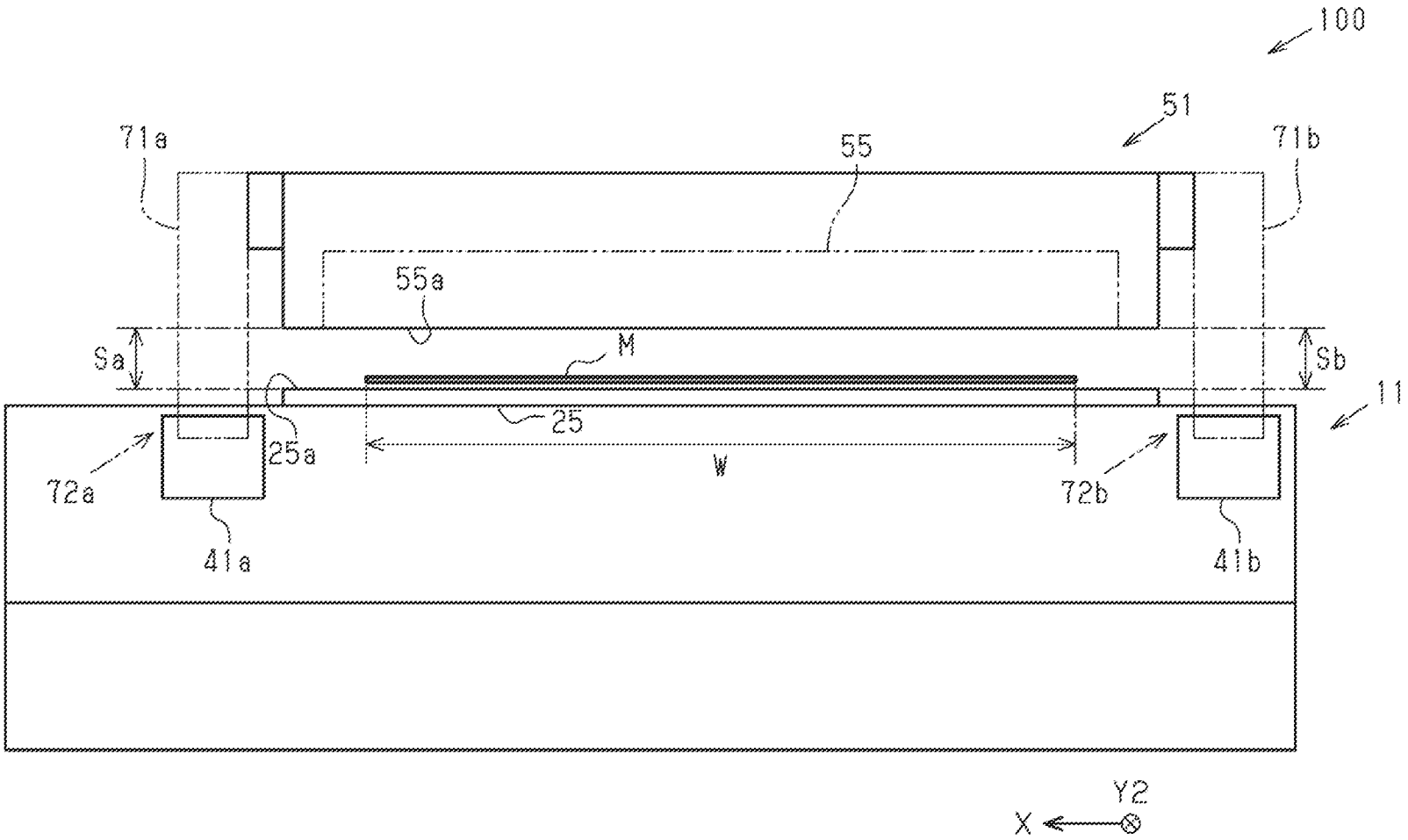
FIG. 3 is a schematic plan view illustrating a positional relationship between a support surface and a drying mechanism as viewed from a second conveyance direction.

As illustrated in FIG. 3, in this embodiment, the recording system 100 includes a first setting member 71*a* serving as the setting member 71 and a second setting member 71*b* serving as the setting member 71. The first setting member 71*a* is provided on one external side of a conveyance range W of the recording medium M in the width direction X of the recording medium M. In addition, the second setting member 71*b* is provided on the other external side of the conveyance range W of the recording medium M in the width direction X of the recording medium M.

In this embodiment, a first spacing Sa, as the spacing S on one external side of the conveyance range W of the recording medium M, is set to a predetermined spacing by the first setting member 71*a*. Further, a second spacing Sb, as the spacing S on the other external side of the conveyance range W of the recording medium M, is set to a predetermined spacing by the second setting member 71*b*. In this manner, at any position in the width direction X of the recording medium M, the spacing S between the support surface 25*a* and the drying mechanism 55 is set to a predetermined spacing. Thus, an appropriate drying process is performed in the entire surface of the recording medium M. More specifically, an appropriate drying process is performed in the entire surface of the recording medium M in such a manner that the drying mechanism 55 heats the entire surface of the recording medium M at an appropriate temperature, and injects air with an appropriate air volume to the entire surface of the recording medium M. FIG. 3 illustrates a state where the first spacing Sa is set to a predetermined spacing by the first setting member 71*a* and the second spacing Sb is set to a predetermined spacing by the second setting member 71*b*.

Note that the recording system 100 may include many more setting members 71, and the spacings S at a plurality of locations may be set to predetermined spacings by such setting members 71. That is, the recording system 100 may include a plurality of the setting members 71, and the spacings S at a plurality of locations may be set to predetermined spacings by the plurality of the setting members 71.

For example, on one external side of the conveyance range W of the recording medium M, the first setting member 71*a* may be provided downstream of the drying mechanism 55 in the second conveyance direction Y2, and a third setting member may be provided upstream of the drying mechanism 55 in the second conveyance direction Y2. In addition, on the other external side of the conveyance range W of the recording medium M, the second setting member 71*b* may be provided downstream of the drying mechanism 55 in the second conveyance direction Y2, and a fourth setting member may be provided upstream of the drying mechanism 55 in the second conveyance direction Y2. Further, with the first setting member 71*a*, the second setting member 71*b*, the third setting member and the fourth setting member, the spacings S at four locations around the drying mechanism 55 may be set to predetermined spacings. In this manner, at the supporting unit 25, the spacing S between the support surface 25*a* and the drying mechanism 55 is set to a predetermined spacing at any position in the width direction X of the recording medium M and the second conveyance direction Y2. Thus, an appropriate drying process is performed in the entire surface of the recording medium M on the support surface 25*a*.

One of the recording device 11 and the drying device 51 includes the first setting member 71*a*. In addition, one of the recording device 11 and the drying device 51 includes the second setting member 71*b*. Note that in this embodiment, the drying device 51 includes the setting member 71. More specifically, the drying device 51 includes the first setting member 71*a* and the second setting member 71*b*. Note that the recording device 11 may include the first setting member 71*a* and the second setting member 71*b*. In addition, the recording device 11 may include the first setting member 71*a*, and the drying device 51 may include the second setting member 71*b*. In addition, the drying device 51 may include the first setting member 71*a*, and the recording device 11 may include the second setting member 71*b*.

In the case where the drying device 51 includes the setting member 71, the recording device 11 includes a mounting unit 41 illustrated in FIG. 2. When the setting member 71 of the drying device 51 is mounted on the mounting unit 41, the drying device 51 is mounted on the recording device 11. Then, when the drying device 51 is mounted on the recording device 11, the spacing S is set to a predetermined spacing by the setting member 71. Note that in the case where the recording device 11 includes the setting member 71, the drying device 51 includes the mounting unit 41.

In this embodiment, the recording device 11 includes a first mounting unit 41*a* and a second mounting unit 41*b*. When the first setting member 71*a* is mounted on the first mounting unit 41*a* serving as the mounting unit 41, and the second setting member 71*b* is mounted on the second mounting unit 41*b* serving as the mounting unit 41, the drying device 51 is mounted on the recording device 11. In other words, when the drying device 51 is mounted on the recording device 11, the first spacing Sa is set to a predetermined spacing by the first setting member 71*a*, and the second spacing Sb is set to a predetermined spacing by the second setting member 71*b*. Note that the first spacing Sa may be changed by adjusting the position of the first mounting unit 41*a* in the depth direction Y. In addition, the second spacing Sb may be changed by adjusting the position of the second mounting unit 41*b* in the depth direction Y.

Drying Mechanism

Figure 4:
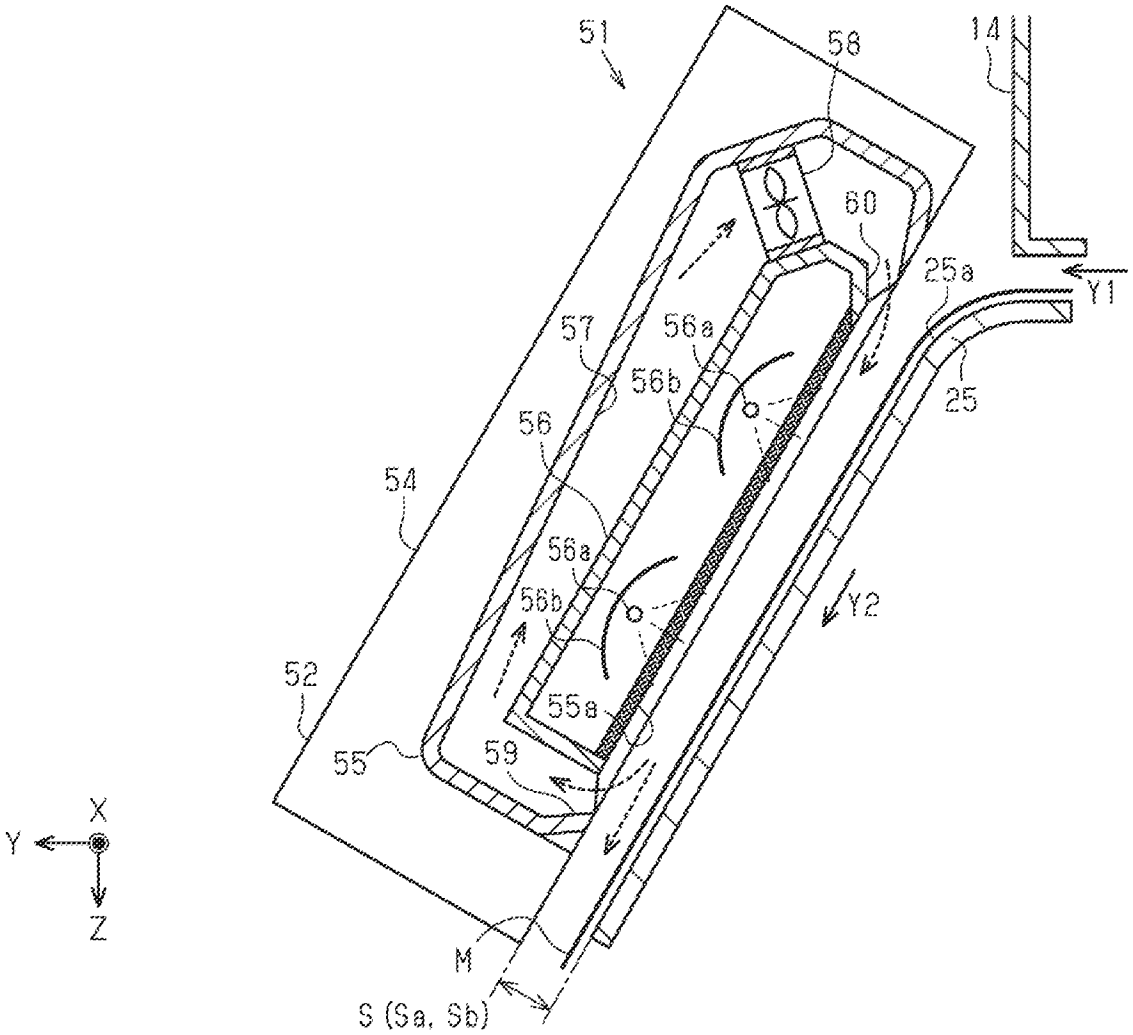
FIG. 4 is a schematic side sectional view illustrating a configuration of the drying mechanism.

As illustrated in FIG. 4, when the drying device 51 is mounted on the recording device 11, the drying mechanism 55 is disposed at a position where the heat dissipation surface 55*a* faces the support surface 25*a*. The drying mechanism 55 includes a heating unit 56 that heats the recording medium M. The heating unit 56 includes a heater pipe 56*a* serving as a heating member, and a reflection plate 56*b* that reflects the heat emitted from the heater pipe 56*a*. By surrounding the back the heater pipe 56*a*, the reflection plate 56*b* reflects the heat emitted to the back of the heater pipe 56*a*, to the support surface 25*a* side. With a plurality of heater pipes 56*a* and reflection plates 56*b* extending in the width direction X, the heat is emitted from the entire heat dissipation surface 55*a* toward the support surface 25*a*. Note that while the heater pipe 56*a* is used as a heating member in this embodiment, it suffices that the heating member may be a member that generates heat. For example, the heating member may be a halogen lamp.

A wire mesh may be disposed at the heat dissipation surface 55*a*. The heat of the heater pipe 56*a* can be transmitted to the recording medium M on the support surface 25*a*, through the wire mesh. In addition, as illustrated in FIG. 4, the heat dissipation surface 55*a* may be provided slightly inside the external shape of the drying device 51, or the heat dissipation surface 55*a* may be provided at the same position as the external shape of the drying device 51.

The drying mechanism 55 includes a channel 57 through which gas flows, and an air blaster 58 that outputs the gas in the channel 57. The gas in the channel 57 is, for example, air. The channel 57 is disposed to surround the heating unit 56. In the channel 57, the gas flows in the direction indicated by the broken line arrow. The channel 57 includes an inlet 59 that opens to the support surface 25*a* and an outlet 60 that opens to the support surface 25*a*. The outlet 60 is located upstream of the inlet 59 in the second conveyance direction Y2. The outlet 60 faces an upstream portion in the second conveyance direction Y2 in the support surface 25*a*. The inlet 59 faces a downstream portion in the second conveyance direction Y2 in the support surface 25*a*.

The air blaster 58 is disposed in a middle portion of the channel 57. The air blaster 58 generates airflow with a rotating fan, and delivers the gas in the channel 57, toward the outlet 60. The gas delivered by the air blaster 58 is sent along the channel 57, and thereafter output from the outlet 60.

The output direction at the outlet 60 is a direction slightly tilted to the side on which the inlet 59 is located. Therefore, a large part of the gas output from the outlet 60 flows along the support surface 25*a* toward the side on which the inlet 59 is located. That is, a large part of the gas output from the outlet 60 flows along the support surface 25*a* toward the downstream side in the second conveyance direction Y2.

A part of the gas that has flowed downstream in the second conveyance direction Y2 along the support surface 25*a* enters the drying mechanism 55 from the inlet 59 again, and the remaining part is ejected downward of the drying device 51 from a portion between the inlet 59 and the support surface 25*a*. The drying mechanism 55 is configured such that a part of the gas output from the outlet 60 circulates inside the drying mechanism 55 through the channel 57.

The drying device 51 dries the recording medium M supported by the support surface 25*a* by injecting the gas to the recording medium M by using the air blaster 58 while heating the recording medium M by using the heating unit 56. That is, when the recording medium M on which liquid is applied is conveyed between the heat dissipation surface 55*a* and the support surface 25*a*, the heat emitted from the heater pipe 56*a* and the gas output from the outlet 60 facilitate the evaporation of the moisture of the liquid adhered on the recording medium M.

If the spacing S between the support surface 25*a* and the drying mechanism 55 is large, the evaporation of the moisture of the liquid adhered on the recording medium M will not be sufficiently performed. In addition, if the spacing S between the support surface 25*a* and the drying mechanism 55 is small and the recording medium M is a sheet for example, the moisture in the sheet fiber making up the sheet may also be lost due to the excessively increased temperature of the sheet, and consequently the quality of the recording medium M after the recording is degraded. Therefore, the setting member 71 sets the spacing S between the support surface 25*a* and the drying mechanism 55 to a predetermined spacing.

Configuration of Recording System

Figure 5:
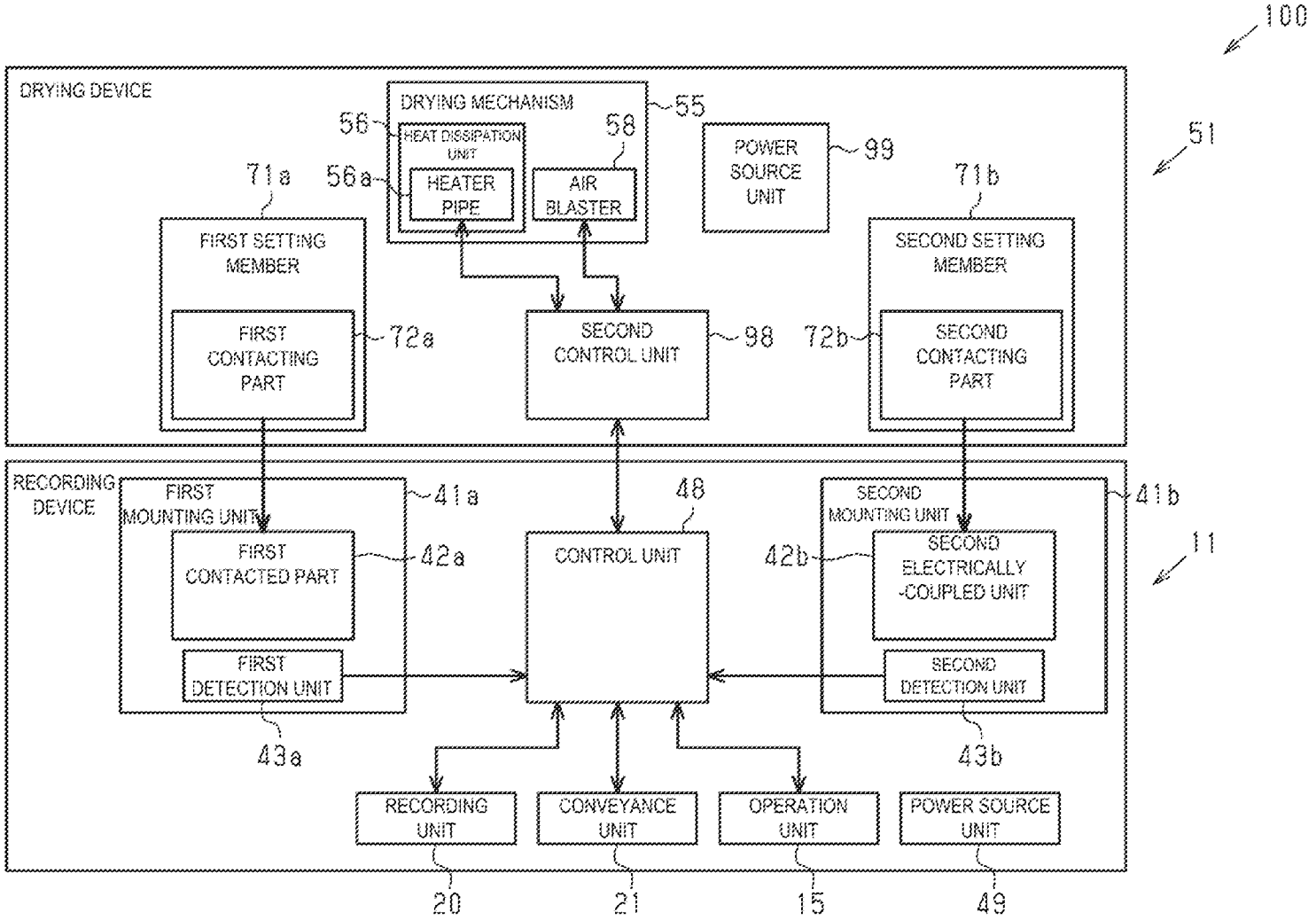
FIG. 5 is a block diagram illustrating a configuration of the recording system according to the first embodiment.

As illustrated in FIG. 5, the recording device 11 includes the recording unit 20 that performs recording on the recording medium M, a conveyance unit 21 that conveys the recording medium M, the operation unit 15 for performing the entire operation of the recording system 100, and a power source unit 49 that supplies power to the recording device 11. Further, the recording device 11 includes a control unit 48 that controls the recording device 11.

The control unit 48 of the recording device 11 controls the recording unit 20 and the conveyance unit 21 on the basis of an operation made by the user at the operation unit 15, such that the conveyance unit 21 conveys the recording medium M while the recording unit 20 performs recording on the recording medium M.

The drying device 51 includes the drying mechanism 55 that dries the recording medium M on which liquid is applied, and a power source unit 99 that supplies power to the drying mechanism 55. The power source unit 99 may supply power not only to the drying mechanism 55, but also to the entire drying device 51. Note that a power cable for supplying power from the recording device 11 to the drying device 51 may be connected between the recording device 11 and the drying device 51 such that the power is supplied from the recording device 11 to portions other than the drying device 51 in the drying device 51. Further, the drying device 51 includes a second control unit 98 that controls the drying device 51.

The control unit 48 of the recording device 11 not only controls the recording device 11, but also controls the drying device 51 through the second control unit 98 of the drying device 51. That is, the control unit 48 controls the recording system 100. The control unit 48 and the second control unit 98 are connected to each other in a wired or wireless manner, and thus information is exchanged between the control unit 48 and the second control unit 98.

The second control unit 98 transmits information about the status of the drying device 51 to the control unit 48. After receiving information about the status of the drying device 51, the control unit 48 transmits a control command or a control parameter for controlling the drying device 51 to the second control unit 98 in accordance with the information about the status of the drying device 51. The second control unit 98 controls the drying mechanism 55 on the basis of the control command or the control parameter, and thus the drying mechanism 55 dries the recording medium M.

For example, the number of the heater pipes 56*a* for heat generation and the rotational frequency of the air blaster 58 are included in the control parameter. The second control unit 98 may control the number of the heater pipes 56*a* for heat generation, the rotational frequency of the air blaster 58 and the like so as to set the surface of the recording medium M to an appropriate state in accordance with the amount of the liquid discharged by the recording unit 20 to the recording medium M.

For example, in the case where the drying mechanism 55 includes a temperature sensor for measuring the temperature of the heat dissipation surface 55*a*, the measurement value obtained by the temperature sensor is included in the information about the status of the drying device 51. The second control unit 98 may transmit the measurement value to the control unit 48. Then, the control unit 48 may transmit the control parameter to the second control unit 98 in accordance with the measurement value. Then, the second control unit 98 may control the heating value and the air volume at the drying mechanism 55 on the basis of the control parameter transmitted from the control unit 48.

Note that the second control unit 98 of the drying device 51 may not be provided. The control unit 48 of the recording device 11 may directly control the drying mechanism 55, with each unit of the drying mechanism 55 and the control unit 48 directly connected to each other.

One of the recording device 11 and the drying device 51 includes the first setting member 71*a*. The first setting member 71*a* includes a first contacting part 72*a* that makes contact with the other of the recording device 11 and the drying device 51. The other of the recording device 11 and the drying device 51 includes a first contacted part 42*a* that is brought into contact with the first contacting part 72*a*.

In this embodiment, the drying device 51 includes the first setting member 71*a* including the first contacting part 72*a*, and the recording device 11 includes the first contacted part 42*a* that is brought into contact with the first contacting part 72*a*. Note that the recording device 11 may include the first setting member 71*a* including the first contacting part 72*a*, and the drying device 51 may include the first contacted part 42*a* that is brought into contact with the first contacting part 72*a*.

One of the recording device 11 and the drying device 51 includes the second setting member 71*b*. The second setting member 71*b* includes a second contacting part 72*b* that makes contact with the other of the recording device 11 and the drying device 51. The other of the recording device 11 and the drying device 51 includes a second contacted part 42*b* that is brought into contact with the second contacting part 72*b*.

In this embodiment, the drying device 51 includes the second setting member 71*b* including the second contacting part 72*b*, and the recording device 11 includes the second contacted part 42*b* that is brought into contact with the second contacting part 72*b*. Note that the recording device 11 may include the second setting member 71*b* including the second contacting part 72*b*, and the drying device 51 may include the second contacted part 42*b* that is brought into contact with the second contacting part 72*b*.

The recording system 100 includes a first detection unit 43*a* that detects contact between the first contacting part 72*a* and the first contacted part 42*a*, and a second detection unit 43*b* that detects contact between the second contacting part 72*b* and the second contacted part 42*b*. When the first contacting part 72*a* makes contact with the first contacted part 42*a*, the first spacing Sa illustrated in FIG. 3 is set to a predetermined spacing. When the second contacting part 72*b* makes contact with the second contacted part 42*b*, the second spacing Sb illustrated in FIG. 3 is set to a predetermined spacing. The notification of the detection result of the first detection unit 43*a* and the second detection unit 43*b* is provided to the control unit 48.

In this embodiment, the recording device 11 includes the first detection unit 43*a* and the second detection unit 43*b*. Note that the drying device 51 may include the first detection unit 43*a* and the second detection unit 43*b*. In addition, the recording device 11 may include the first detection unit 43*a*, and the drying device 51 may include the second detection unit 43*b*. In addition, the recording device 11 may include the second detection unit 43*b*, and the drying device 51 may include the first detection unit 43*a*.

The drying mechanism 55 functions when the spacing S illustrated in FIG. 2 between the support surface 25*a* and the drying mechanism 55 is set to a predetermined spacing by the setting member 71, and the function of the drying mechanism 55 stops when the setting by the setting member 71 is released. Note that "drying mechanism functions" means that the heat generation at the heater pipe 56*a* is started in response to the start of the energization to the heater pipe 56*a* illustrated in FIG. 4. In addition, "the function of the drying mechanism stops" means that the heat generation at the heater pipe 56*a* is stopped in response to the stop of the energization to the heater pipe 56*a* illustrated in FIG. 4. Note that the rotation of the air blaster 58 may be started when the spacing S between the support surface 25*a* and the drying mechanism 55 is set to a predetermined spacing by the setting member 71. In addition, the rotation of the air blaster 58 may be stopped when the setting by the setting member 71 is released.

In the case where the recording system 100 includes a plurality of the setting members 71, the spacings S at a plurality of locations are set to predetermined spacings by the plurality of the setting members 71. The drying mechanism 55 functions when all of the spacings S of the plurality of locations are set to a predetermined spacing, and the function of the drying mechanism 55 stops when the setting of at least one of the plurality of setting members 71 is released.

In this embodiment, the drying mechanism 55 functions when contact between the first contacting part 72*a* and the first contacted part 42*a* is detected by the first detection unit 43*a* and contact between the second contacting part 72*b* and the second contacted part 42*b* is detected by the second detection unit 43*b*. The function of the drying mechanism 55 stops when at least one of the first detection unit 43*a* and the second detection unit 43*b* does not detect contact. That is, the drying mechanism 55 functions when the first spacing Sa illustrated in FIG. 3 is set to a predetermined spacing by the first setting member 71*a*, and the second spacing Sb illustrated in FIG. 3 is set to a predetermined spacing by the second setting member 71*b*. The function of the drying mechanism 55 stops when the setting of at least one of the first setting member 71*a* and the second setting member 71*b* is released.

The control unit 48 of the recording device 11 controls the entire recording system 100. Specifically, the control unit 48 causes the drying mechanism 55 to function when the spacing S between the support surface 25*a* and the drying mechanism 55 is set to a predetermined spacing by the setting member 71, and the control unit 48 stops the function of the drying mechanism 55 when the setting by the setting member 71 is released.

In this embodiment, when the first spacing Sa illustrated in FIG. 3 is set to a predetermined spacing by the first setting member 71*a*, and the second spacing Sb illustrated in FIG. 3 is set to a predetermined spacing by the second setting member 71*b*, the control unit 48 of the recording device 11 causes the drying mechanism 55 to function. When the setting of at least one of the first setting member 71*a* and the second setting member 71*b* is released, the control unit 48 of the recording device 11 stops the function of the drying mechanism 55.

When the setting of at least one of the first setting member 71*a* and the second setting member 71*b* is released, the control unit 48 provides the user with a notification that the drying device 51 is not properly mounted on the recording device 11. For example, the display unit 15*a* may indicate the fact that the drying device 51 is not properly mounted on the recording device 11. In addition, when the drying device 51 is not properly mounted on the recording device 11, the control unit 48 may provide a notification to the user, with a contact sound, an artificial voice or the like.

Configuration of Mounting Unit

Figure 6:
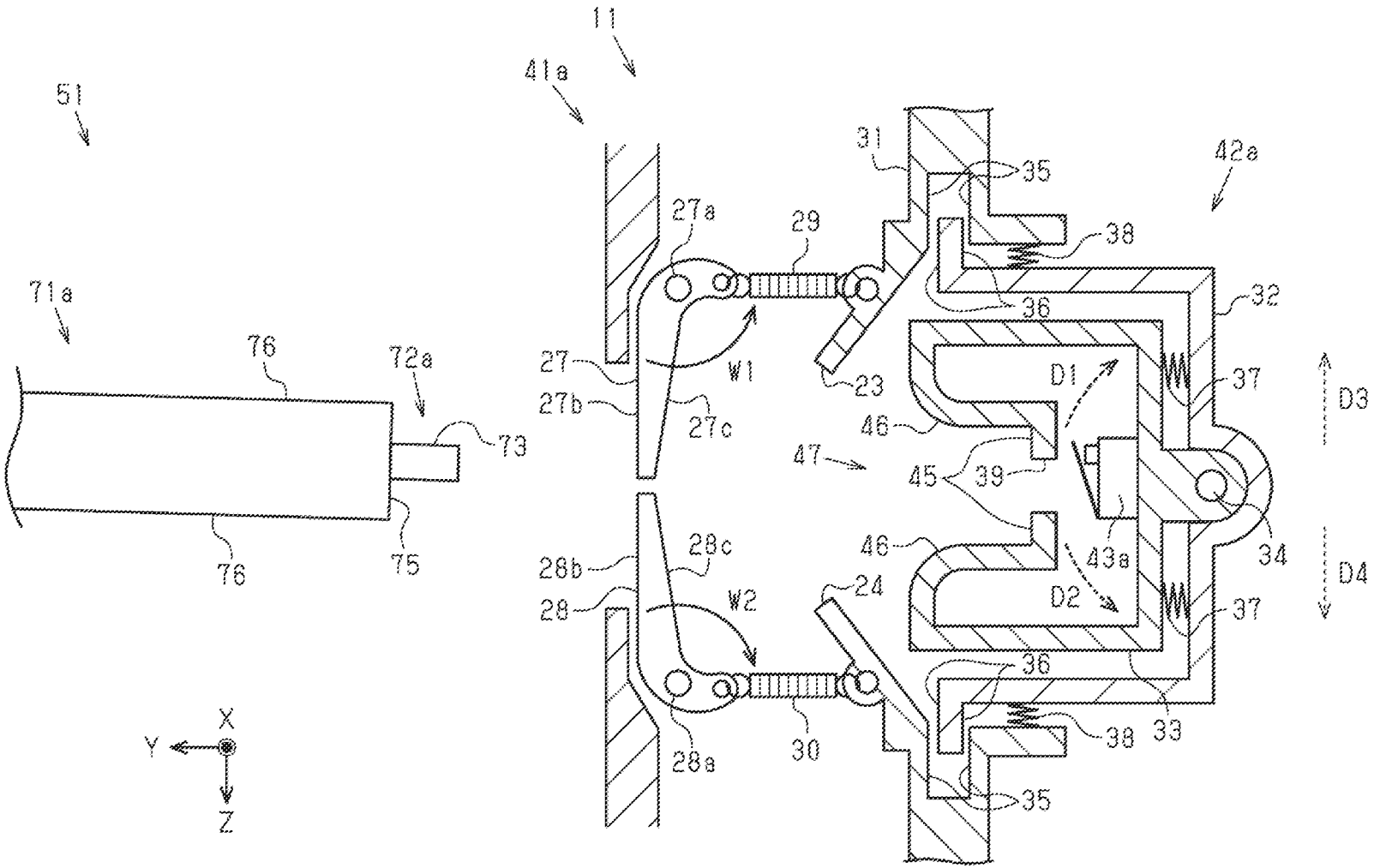
FIG. 6 is a schematic sectional view illustrating a setting member and a mounting unit according to the first embodiment.

As illustrated in FIG. 6, the first setting member 71*a* has a substantially columnar shape, and includes a guided surface 76 that forms the side surface of the column, and the first contacting part 72*a* that forms the tip end portion of the column. The first contacting part 72*a* is composed of a contacting surface 75 that makes contact with the first mounting unit 41*a*, and a detection target part 73 protruding at a center portion on the contacting surface 75. One end (not illustrated in the drawing) of the first setting member 71*a* is axially supported by one of the recording device 11 and the drying device 51.

The first mounting unit 41*a* includes the first contacted part 42*a*. The first contacted part 42*a* is composed of a fixing part 31, a sliding part 32, and a tilting unit 33. The fixing part 31 is a portion configured to be fixed to the first mounting unit 41*a* in the first contacted part 42*a*. The sliding part 32 is a portion configured to slide on the fixing part 31 in the vertical direction Z in the first contacted part 42*a*. The tilting unit 33 is a portion configured to be tilted with respect to the sliding part 32 in the rotational direction around the X axis in the first contacted part 42*a*. The tilting unit 33 includes a contact surface 45 that makes contact with the contacting surface 75 of the first contacting part 72*a*. That is, when the first setting member 71*a* is mounted on the first mounting unit 41*a*, the contacting surface 75 of the first contacting part 72*a* makes contact with the contact surface 45 of the first contacted part 42*a*. Then, when the contacting surface 75 makes contact with the contact surface 45, the first spacing Sa illustrated in FIG. 3 is set to a predetermined spacing by the first setting member 71*a*.

Around a tilting center 34 located at the center of the sliding part 32 in the vertical direction Z, the tilting unit 33 is configured to be tiltable in tilting directions D1 and D2 indicated by the broken line arrow of FIG. 6 with respect to the sliding part 32. A plurality of biasing members 37 are disposed between the tilting unit 33 and the sliding part 32. In this manner, before the first setting member 71*a* is mounted, the tilting unit 33 can maintain an approximately horizontal position with respect to the sliding part 32. When the first setting member 71*a* is mounted, the tilting unit 33 can tilt with respect to the sliding part 32 in the rotational direction around the X axis in accordance with the inclination of the first setting member 71*a*.

The tilting unit 33 includes a recess 47 at the center of the surface that faces the contacting surface 75 of the first setting member 71*a*. The recess 47 has a shape in which a hole 39 is open at the center of the bottom surface of a flare-shaped hole portion. In other words, the recess 47 is composed of a flare-shaped guiding surface 46 as the side surface of the hole portion, and the contact surface 45 as the bottom surface of the hole portion. The guiding surface 46 is formed in a shape in which the entrance side of the hole slightly flares out. In other words, the guiding surface 46 includes an inclined surface on the entrance side of the recess 47, and a columnar hole-shaped portion on the depth side of the recess 47. The columnar shaped guided surface 76 and the columnar hole-shaped portion in the guiding surface 46 are formed in sizes that can fit with each other. The first detection unit 43*a* is disposed on the depth side of the hole 39. When the first setting member 71*a* is mounted, the first detection unit 43*a* detects the detection target part 73 protruded from the hole 39.

The sliding part 32 includes a sliding surface 36. The fixing part 31 includes a slide surface 35. When the sliding surface 36 slides on the slide surface 35, the sliding part 32 along with the tilting unit 33 slides in the sliding directions D3 and D4 indicated by the broken line arrow of FIG. 6 with respect to the fixing part 31. A plurality of biasing members 38 is disposed between the sliding part 32 and the fixing part 31. In this manner, before the first setting member 71*a* is mounted, the sliding part 32 can maintain an approximate center position with respect to the fixing part 31. When the first setting member 71*a* is mounted, the sliding part 32 slides in the vertical direction Z with respect to the fixing part 31 in accordance with the position of the first setting member 71*a* the vertical direction Z.

The first mounting unit 41*a* includes an upper opening-closing member 27 and a lower opening-closing member 28. The recess 47 is closed with the upper opening-closing member 27 and the lower opening-closing member 28. When the first setting member 71*a* is mounted, the upper opening-closing member 27 turns in a counterclockwise direction W1 around a turning center 27*a*, and thus the upper side of the recess 47 opens. When the first setting member 71*a* is mounted, the lower opening-closing member 28 turns in a clockwise direction W2 around a turning center 28*a*, and thus the lower side of the recess 47 opens.

The first mounting unit 41*a* includes biasing members 29 and 30. The biasing member 29 biases the upper opening-closing member 27 in the direction in which the upper opening-closing member 27 closes the upper side of the recess 47. The biasing member 30 biases the lower opening-closing member 28 in the direction in which the lower opening-closing member 28 closes the lower side of the recess 47. In this manner, before the first setting member 71*a* is mounted, the recess 47 can be closed with the upper opening-closing member 27 and the lower opening-closing member 28. That is, when the first setting member 71*a* is not mounted, the recess 47 can be made invisible, and the user can be prevented from touching the first detection unit 43*a* disposed on the depth side of the hole 39 of the recess 47. Further, when the first setting member 71*a* is mounted, the recess 47 can open, with the tip end portion of the first setting member 71*a* pushing an outer surface 27*b* of the upper opening-closing member 27 and an outer surface 28*b* of the lower opening-closing member 28.

When the upper opening-closing member 27 excessively opens, an inner surface 27*c* of the upper opening-closing member 27 makes contact with a hitting surface 23 so as to limit the turning range of the upper opening-closing member 27. In addition, when the lower opening-closing member 28 excessively opens, an inner surface 28*c* of the lower opening-closing member 28 makes contact with a hitting surface 24 so as to limit the turning range of the lower opening-closing member 28. Note that the outer surface 27*b* and the guiding surface 46 may form a tilted surface for guiding the upper side of the first contacting part 72*a* to the direction of the recess 47 when the inner surface 27*c* of the upper opening-closing member 27 makes contact with the hitting surface 23. In addition, the outer surface 28*b* and the guiding surface 46 may form a tilted surface for guiding the lower side of the first contacting part 72*a* to the direction of the recess 47 when the inner surface 28*c* of the lower opening-closing member 28 makes contact with the hitting surface 24.

The recording device 11 and the drying device 51 are installed on the floor surface 101. Materials with cushioning properties such as mats and carpets are often used for the floor surface 101. As such, the recording device 11 and the drying device 51 depress the floor surface 101 with their weight. That is, depending on the weights of the recording device 11 and the drying device 51, the state of the floor surface 101 and the like, the depressing amount of the casters 13*a* and 53*a* in the vertical direction Z differs. Therefore, the heights and angles of the recording device 11 and the drying device 51 with respect to the floor surface 101 change depending on the states.

The first mounting unit 41*a* is configured such that the first setting member 71*a* can be mounted on the first mounting unit 41*a* even when the heights and angles of the recording device 11 and the drying device 51 with respect to the floor surface 101 change. Specifically, the tilting unit 33 tilts with respect to the sliding part 32 in the rotational direction around the X axis, and the sliding part 32 slides in the vertical direction Z with respect to the fixing part 31, and thus, the first setting member 71*a* can be mounted on the first mounting unit 41*a* even in the above-mentioned case.

The recording system 100 may be configured such that the height of at least one of the recording device 11 and the drying device 51 can be adjusted. For example, a caster that can adjust the height may be used for the casters 13*a* and 53*a*. When the height of the device is configured to be adjustable, the tilting range and the slide movement range at the first mounting unit 41*a* can be reduced. That is, the size of the first mounting unit 41*a* can be reduced.

The sliding part 32 may be configured to be slidable with respect to the fixing part 31, not only in the vertical direction Z, but also in the width direction X. Depending on the accuracy of each member, the distance between the first setting member 71*a* and the second setting member 71*b* and the distance between the first mounting unit 41*a* and the second mounting unit 41*b* may differ. Even in such a case, with the sliding of the sliding part 32 in the width direction X, the first setting member 71*a* and the second setting member 71*b* can be mounted on the first mounting unit 41*a* and the second mounting unit 41*b*, respectively.

The tilting unit 33 may be configured to be tiltable with respect to the sliding part 32 not only in the rotational direction around the X axis, but also in the rotational direction around the Z axis. Depending on the accuracy of each member, the first setting member 71*a* and the second setting member 71*b* may not be parallel to each other. Even in such a case, with the tilting unit 33 tilting also in the rotational direction around the Z axis, the first setting member 71*a* and the second setting member 71*b* can be mounted on the first mounting unit 41*a* and the second mounting unit 41*b*, respectively.

The distance between the first setting member 71*a* and the second setting member 71*b* is determined by the attaching position of the first setting member 71*a* to the drying device 51 and the attaching position of the second setting member 71*b* to the drying device 51. Therefore, the drying device 51 may be configured such that the position can be adjusted in the width direction X for at least one of the two attaching positions. In addition, the distance between the first mounting unit 41*a* and the second mounting unit 41*b* is determined by the attaching position of the first mounting unit 41*a* to the recording device 11, and the attaching position of the second mounting unit 41*b* to the recording device 11. Therefore, the recording device 11 may be configured such that the position can be adjusted in the width direction X for at least one of the two attaching positions.

In addition, the drying device 51 may be configured such that the angle of the first setting member 71*a* in the first posture with respect to the floor surface 101, and the angle of the second setting member 71*b* in the first posture with respect to the floor surface 101 can be adjusted.

Note that the configurations of the second setting member 71*b* and the second mounting unit 41*b* are the same as the configurations of the first setting member 71*a* and the first mounting unit 41*a*. Therefore, the description of the configurations of the second setting member 71*b* and the second mounting unit 41*b* will be omitted. Note that at the second mounting unit 41*b*, the second spacing Sb illustrated in FIG. 3 is set to a predetermined spacing by the second setting member 71*b* when the contacting surface 75 makes contact with the contact surface 45.

Mounting Operation

Figure 7:
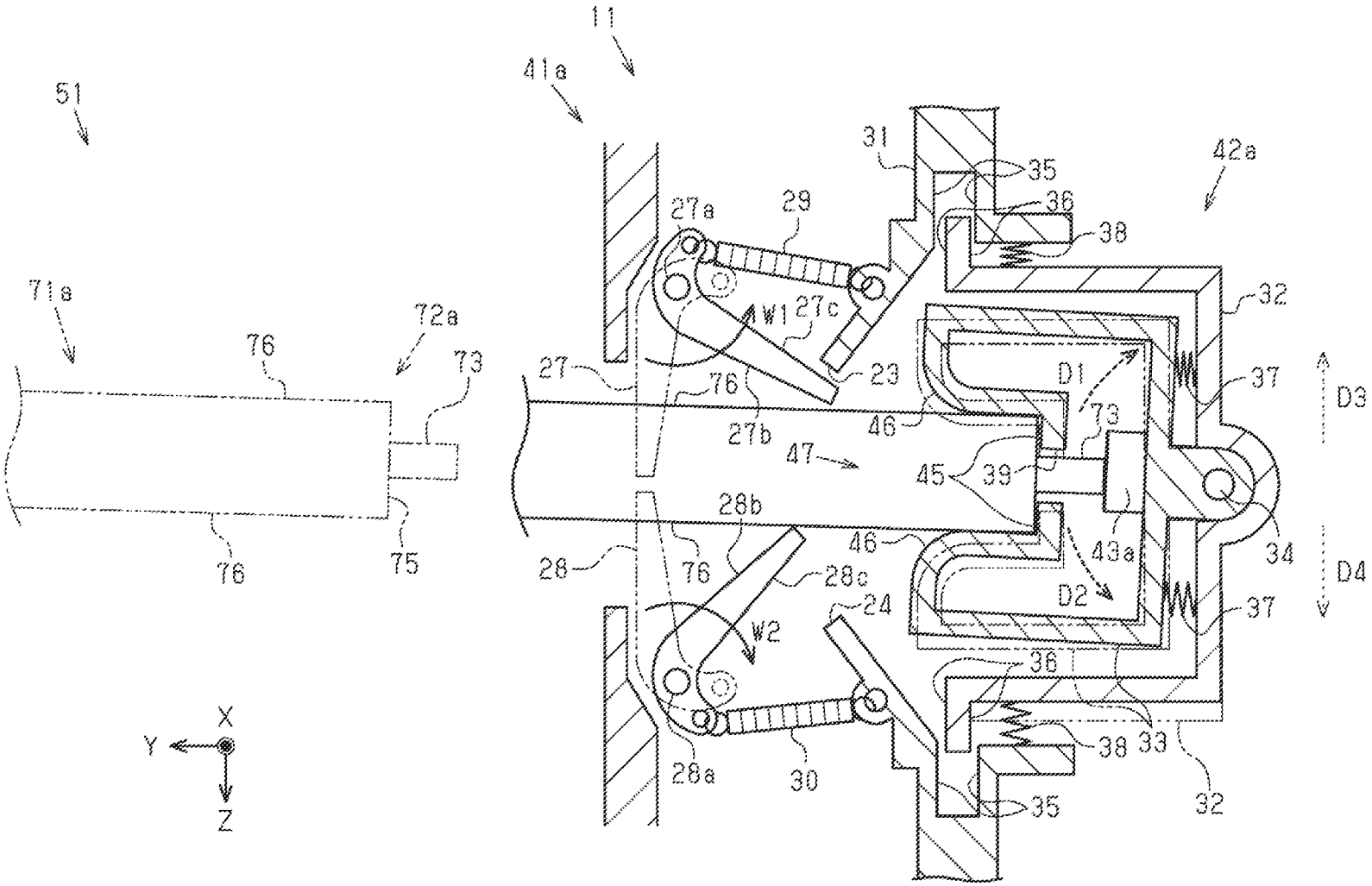
FIG. 7 is a schematic sectional view illustrating a state where the setting member is mounted on the mounting unit according to the first embodiment.

As illustrated in FIG. 7, the first setting member 71*a* is mounted on the first mounting unit 41*a*. An operation performed in the first mounting unit 41*a* at that time will be sequentially described.

When the first contacting part 72*a* pushes the outer surface 27*b* of the upper opening-closing member 27 and the outer surface 28*b* of the lower opening-closing member 28, the first contacting part 72*a* begins to enter the first contacted part 42*a*. When the upper opening-closing member 27 turns around the turning center 27*a* in the counterclockwise direction W1 from the position indicated by the chain double-dashed line to the position indicated by the solid line, the upper side of the recess 47 opens. Then, when the lower opening-closing member 28 turns around the turning center 28*a* in the clockwise direction W2 from the position indicated by the chain double-dashed line to the position indicated by the solid line, the lower side of the recess 47 opens.

The first contacting part 72*a* hits the guiding surface 46 of the recess 47. Then, the tilting unit 33 tilts in the tilting directions D1 and D2 with respect to the sliding part 32 from the position indicated by the chain double-dashed line to the position indicated by the solid line, and thus the recess 47 moves such that the angle of the guiding surface 46 becomes an angle along the guided surface 76. Then, when the sliding part 32 slides in the sliding directions D3 and D4 with respect to the fixing part 31 from the position indicated by the chain double-dashed line to the position indicated by the solid line, the recess 47 moves such that the position of the guiding surface 46 becomes a position along the guided surface 76. In addition, when the first contacting part 72*a* is pushed while making contact with the inclined surface on the entrance side of the recess 47 in the guiding surface 46, the first contacting part 72*a* is guided to the depth side of the recess 47 and the center of the recess 47. That is, as the first contacting part 72*a* is pushed into the recess 47, the angle and the position of the recess 47 are adjusted with respect to the first contacting part 72*a*. When the first contacting part 72*a* is further pushed to the recess 47 in that state, the columnar shaped guided surface 76 and the columnar hole-shaped portion in the guiding surface 46 fit each other. That is, the first contacting part 72*a* is inserted to the first contacted part 42*a*.

When the first contacting part 72*a* is inserted to the first contacted part 42*a*, the first contacting part 72*a* of the detection target part 73 is protruded from the hole 39 of the recess 47. Then, when the contacting surface 75 of the first contacting part 72*a* makes contact with the first contacted part 42*a* of the contact surface 45, the first detection unit 43*a* disposed on the depth side of the hole 39 detects the detection target part 73 protruded from the hole 39. The first detection unit 43*a* is, for example, a small-sized switch. When the detection target part 73 pushes the lever of the switch, the contact point (not illustrated in the drawing) shorts the electric circuit, and thus the first detection unit 43*a* detects contact between the contacting surface 75 and the contact surface 45.

The contacting surface 75 may serve also as the detection target part 73. At the hole 39, the lever of the switch is disposed at a position protruded from the contact surface 45, for example. The switch serving as the first detection unit 43*a* may detect contact between the contacting surface 75 and the contact surface 45 when the contacting surface 75 makes contact with the contact surface 45 and the contacting surface 75 pushes the lever of the switch.

It suffices that the first detection unit 43*a* can detect that the position of the detection target part 73 in the depth direction Y is located at a predetermined position. For example, the first detection unit 43*a* may be a transmissive optical sensor, and the detection target part 73 may be a shield plate for shielding between a light reception unit and a light emission unit of the transmissive optical sensor. For example, the first detection unit 43*a* may be a proximity sensor such that the proximity sensor detects the detection target part 73 when the detection target part 73 approaches the detection surface of the proximity sensor to a predetermined distance.

Note that the configurations of the second setting member 71*b* and the second mounting unit 41*b* are the same as the configurations of the first setting member 71*a* and the first mounting unit 41*a*. Therefore, the description of the operations performed at the second mounting unit 41*b* when the second setting member 71*b* is mounted on the second mounting unit 41*b* will be omitted.

Operation of Embodiment

Operations of this embodiment will be described below.

When the drying device 51 is not used, the posture of the setting members 71*a* and 71*b* is the second posture in which the footprint is smaller than in the first posture. In this manner, when the drying device 51 is no used, the size of the drying device 51 in the depth direction Y is smaller than when the drying device 51 is used, and the drying device 51 can be housed in a narrow space.

In the case where the amount of the liquid discharged to the recording medium M is large, the drying device 51 is used to dry the recording medium M on which a large amount of liquid is applied. After unlocking the roller of the caster 53*a*, the user can move the drying device 51 from the housing location, with the roller rotating on the floor surface 101.

After moving the drying device 51 to a location close to the recording device 11, the user changes the first setting member 71*a* and the second setting member 71*b* to the second posture illustrated in FIG. 2. Then, the drying device 51 is disposed to the recording device 11 in the state where the first contacting part 72*a*, which is the tip end portion of the first setting member 71*a*, faces the direction of the first mounting unit 41*a*, and the second contacting part 72*b*, which is the tip end portion of the second setting member 71*b*, faces the direction of the second mounting unit 41*b*.

On the floor surface 101, the user moves the drying device 51 in the direction in which the drying device 51 approaches the recording device 11. The roller of the caster 53*a* rotates on the floor surface 101, and thus the drying device 51 can be easily brought closer to the recording device 11.

When the first contacting part 72*a* pushes the outer surface 27*b* of the upper opening-closing member 27 and the outer surface 28*b* of the lower opening-closing member 28, the first contacting part 72*a* begins to enter the first mounting unit 41*a*. Then, when the second contacting part 72*b* pushes the outer surface 27*b* of the upper opening-closing member 27 and the outer surface 28*b* of the lower opening-closing member 28, the second contacting part 72*b* begins to enter the second mounting unit 41*b*. Note that since the installation at the recording device 11 has been completed, the roller of the caster 13*a* is locked. Therefore, when the outer surfaces 27*b* and 28*b* are pushed, the recording device 11 does not move.

When the first contacting part 72*a* is pushed into the recess 47, the contacting surface 75 of the first contacting part 72*a* makes contact with the contact surface 45 of the first contacted part 42*a*. Through this contact, the first detection unit 43*a* disposed on the depth side of the hole 39 detects the detection target part 73 protruded from the hole 39.

At the first mounting unit 41*a*, the first spacing Sa is set to a predetermined spacing by the first setting member 71*a* when the contacting surface 75 makes contact with the contact surface 45. From the detection result of the first detection unit 43*a*, the control unit 48 can detect the fact that the first spacing Sa is set to a predetermined spacing by the first setting member 71*a*.

In this state, the first spacing Sa is set to a predetermined spacing by the first setting member 71*a*, but the second spacing Sb has not yet been set to a predetermined spacing by the second setting member 71*b*. Therefore, the control unit 48 does not cause the drying mechanism 55 to function. Specifically, the drying device 51 can be prevented from functioning when the drying device 51 is not mounted in the state where the recording device 11 and the drying device 51 are in an appropriate positional relationship.

In this state, when the second contacting part 72*b* is further pushed into the recess 47, the contacting surface 75 of the second contacting part 72*b* makes contact with the contact surface 45 of the second contacted part 42*b*. Through this contact, the second detection unit 43*b* disposed on the depth side of the hole 39 detects the detection target part 73 protruded from the hole 39.

At the second mounting unit 41*b*, when the contacting surface 75 makes contact with the contact surface 45, and the second spacing Sb is set to a predetermined spacing by the second setting member 71*b*. From the detection result of the second detection unit 43*b*, the control unit 48 can detect the fact that the second spacing Sb is set to a predetermined spacing by the second setting member 71*b*.

In this state, the first spacing Sa is set to a predetermined spacing by the first setting member 71*a*, and the second spacing Sb is set to a predetermined spacing by the second setting member 71*b*. In addition, with the first setting member 71*a* and the second setting member 71*b*, the position of the drying mechanism 55 in the second conveyance direction Y2 is set to a predetermined position on the support surface 25*a*. The user fixes the position of the drying device 51 by locking the roller of the caster 53*a*. In this state, the control unit 48 causes the drying mechanism 55 to function. Specifically, the drying device 51 can be allowed to function when the drying device 51 is mounted in the state where the recording device 11 and the drying device 51 are in an appropriate positional relationship. Since the recording device 11 and the drying device 51 are in an appropriate positional relationship, the recording medium M can be heated at the temperature set by the user.

The position of the drying device 51 may move when the drying device 51 is pushed due to an unexpected contact between the housing 52 of the drying device 51 and the user and the surface of the locked roller of the caster 53*a* slips on the floor surface 101. In this manner, for example, when the contacting surface 75 of the second setting member 71*b* is separated from the contact surface 45, the second detection unit 43*b* stops detecting the detection target part 73. At this time, from the detection result of the second detection unit 43*b*, the control unit 48 can detect the fact that the setting by the second setting member 71*b* has been released.

In this state, the first spacing Sa is set to a predetermined spacing by the first setting member 71*a*, but the second spacing Sb has not yet been set to a predetermined spacing by the second setting member 71*b*. Therefore, the control unit 48 stops the function of the drying mechanism 55. The control unit 48 may stop the entire recording system 100 including the function of the drying mechanism 55. That is, the function of the drying device 51 can be stopped when the recording device 11 and the drying device 51 are no longer in an appropriate positional relationship.

The control unit 48 provides the user with a notification that the drying device 51 is not properly mounted on the recording device 11 by displaying the notification on the display unit 15*a*. When the user who sees this display properly mounts the drying device 51 to the recording device 11 again, the control unit 48 causes the drying device 51 to function again. In this manner, the recording system 100 can be operated again in the state where the recording device 11 and the drying device 51 are in an appropriate positional relationship.

When the use of the drying device 51 is completed, the user detaches the drying device 51 from the recording device 11. The user can easily separate the drying device 51 from the recording device 11 by moving the drying device 51 in the direction away from the recording device 11 on the floor surface 101 after unlocking the roller of the caster 53*a*.

The recess 47 is closed with the upper opening-closing member 27 and the lower opening-closing member 28. Thus, it is possible to prevent a situation where the first detection unit 43*a* and the second detection unit 43*b* are mistakenly brought into the detection state due to something other than the detection target part 73. After changing the posture of the first setting member 71*a* and the second setting member 71*b* from the second posture to the first posture, the user moves the drying device 51 to the housing location and houses it.

When the recording device 11 is separated from the drying device 51, the portion of the support surface 25*a* where the drying mechanism 55 has been mounted is exposed. Specifically, since the user can also touch the portion where the drying mechanism 55 has been mounted, the cleaning of the support surface 25*a*, which is the conveyance path of the recording medium M, can be easily performed.

Effect of Embodiment

Effects of this embodiment will be described below.

The recording system 100 and the drying device 51 of this embodiment provide the following effects.

(1) With the first setting member 71*a*, the first spacing Sa on one external side of the conveyance range W of the recording medium M in the width direction X of the recording medium M is set to a predetermined spacing. In this manner, on one side, the surface to be dried in the recording medium M and the surface for drying the recording medium M in the drying mechanism 55 have an appropriate positional relationship. In addition, the second spacing Sb on the other external side of the conveyance range W of the recording medium M in the width direction X of the recording medium M is set to a predetermined spacing by the second setting member 71*b*. In this manner, on the other side, the surface to be dried in the recording medium M and the surface for drying the recording medium M in the drying mechanism 55 have an appropriate positional relationship. That is, with the first setting member 71*a* and the second setting member 71*b*, the surface to be dried in the recording medium M and the surface for drying the recording medium M in the drying mechanism 55 have an appropriate positional relationship in the range from one side to the other side in the width direction X of the recording medium M. The drying mechanism 55 functions when the first spacing Sa on one side is set to a predetermined spacing by the first setting member 71*a*, and the second spacing Sb on the other side is set to a predetermined spacing by the second setting member 71*b*. In this manner, the recording medium M can be dried in an appropriate state from one side to the other side. In addition, the function of the drying mechanism 55 stops when the setting of at least one of the first setting member 71*a* and the second setting member 71*b* is released. In this manner, a situation where the drying mechanism 55 functions in the state where the surface on one side in the recording medium M in the width direction X of the recording medium M is not appropriately dried can be reduced.

(2) The first spacing Sa is set to a predetermined spacing by the first contacting part 72*a* of the first setting member 71*a* making contact with the first contacted part 42*a*. Since the positional relationship is uniformly determined through the hitting of the members against each other, the first spacing Sa can be reliably set to a predetermined spacing. The second spacing Sb is set to a predetermined spacing by the second contacting part 72*b* of the second setting member 71*b* making contact with the second contacted part 42*b*. Since the positional relationship is uniformly determined through the hitting of the members against each other, the second spacing Sb can be reliably set to a predetermined spacing.

(3) The recording system 100 includes the first detection unit 43*a* that detects contact between the first contacting part 72*a* and the first contacted part 42*a*, and the second detection unit 43*b* that detects contact between the second contacting part 72*b* and the second contacted part 42*b*. Of the recording device 11 and the drying device 51, only the device that includes the first detection unit 43*a* forms the circuit for the first detection unit 43*a* to detect the contact. In addition, of the recording device 11 and the drying device 51, only the device that includes the second detection unit 43*b* forms the circuit for the second detection unit 43*b* to detect the contact. That is, since the circuit for detecting the contact is formed with only one of the devices, the configuration of the circuit of the recording system 100 can be simplified.

(4) The recording device 11 and the drying device 51 are installed on the same plane with the support surface 25*a* extending in the direction that intersects that plane, and the drying device 51 moves on the plane, and thus, the drying device 51 is mounted on the recording device 11 from the direction parallel to that plane. The spacings Sa and Sb between the support surface 25*a* and the drying mechanism 55 can be easily set to a predetermined spacing by mounting the drying device 51 to the recording device 11 from the direction that intersects the support surface 25*a* while the drying device 51 is moved by the user on the floor surface 101, which is the installation surface. In addition, the drying device 51 can be easily separated from the recording device 11 by moving the drying device 51 in the direction away from the recording device 11.

(5) The recording device 11 includes the control unit 48 that controls the recording system 100. The control unit 48 causes the drying mechanism 55 to function when the spacings Sa and Sb are set to a predetermined spacing by the setting members 71*a* and 71*b*, and the control unit 48 stops the function of the drying mechanism 55 when the setting by the setting members 71*a* and 71*b* is released. By controlling the recording system 100 by the recording device 11, the drying mechanism 55 of the drying device 51 can be controlled so as to set the surface of the recording medium M to an appropriate state in accordance with the amount of the liquid discharged by the recording unit 20 to the recording medium M. In addition, not only stopping the function of the drying mechanism 55 when there is an abnormality in the drying mechanism 55, but also stopping the entire recording system 100, including the recording device 11, at an appropriate timing can be achieved. That is, by controlling the recording system 100 by the recording device 11, the recording device 11 and the drying device 51 can be controlled in cooperation with each other.

(6) Power is supplied from the power source unit 99 provided in the drying device 51 to the drying mechanism 55. Thus, the capacity of the power source of the power source unit 49 provided in the recording device 11 can be reduced by the capacity of the power source required for the power to be supplied to the drying mechanism 55. That is, more than the necessary burden in terms of cost can be prevented from being put on the user who does not require the drying device 51 among the users of the recording device 11.

(7) The setting members 71*a* and 71*b* are configured such that the posture is switchable between the first posture for setting the spacings Sa and Sb to a predetermined spacing, and the second posture in which the footprint at the setting members 71*a* and 71*b* is smaller than in the first posture. In this manner, when the user does not use the drying device 51, the drying device 51 can be housed in a narrow place by switching the posture of the drying device 51 to the second posture in which the footprint at the setting members 71*a* and 71*b* is smaller than in the first posture.

(8) The first mounting unit 41*a* and the second mounting unit 41*b* include the upper opening-closing member 27 and the lower opening-closing member 28. When the drying device 51 is mounted on the recording device 11, the tip end portions of the first setting member 71*a* and the second setting member 71*b* push the outer surface 27*b* of the upper opening-closing member 27 and the outer surface 28*b* of the lower opening-closing member 28, and thus the recess 47 opens. This eliminates the need for the user to perform the operation of opening the recess 47, and thus the first setting member 71*a* and the second setting member 71*b* can be easily mounted on the first mounting unit 41*a* and the second mounting unit 41*b*.

(9) Depending on the weights of the recording device 11 and the drying device 51, the state of the floor surface 101 and the like, the depressing amount of the casters 13*a* and 53*a* in the vertical direction Z differs. The mounting units 41*a* and 41*b* include the sliding part 32 that slides in the vertical direction Z. Even when the heights of the recording device 11 and the drying device 51 with respect to the floor surface 101 change, the heights of the mounting units 41*a* and 41*b* are adjusted to the heights of the setting members 71*a* and 71*b*, and thus the setting members 71*a* and 71*b* can be mounted on the mounting units 41*a* and 41*b*.

(10) Depending on the weights of the recording device 11 and the drying device 51, the state of the floor surface 101 and the like, the depressing amount of the casters 13*a* and 53*a* in the vertical direction Z differs, and the angles of the recording device 11 and the drying device 51 with respect to the floor surface 101 change. The mounting units 41*a* and 41*b* include the tilting unit 33 that tilts in the rotational direction around the X axis. Even when the angles of the recording device 11 and the drying device 51 with respect to the floor surface 101 change, the angles of the mounting units 41*a* and 41*b* are adjusted to the angles of the setting members 71*a* and 71*b*, and thus the setting members 71*a* and 71*b* can be mounted on the mounting units 41*a* and 41*b*.

(11) The mounting units 41*a* and 41*b* include the recess 47. The guiding surface 46 provided in the recess 47 includes an inclined surface on the entrance side of the recess 47. When the user mounts the setting members 71*a* and 71*b* by pushing them into the mounting units 41*a* and 41*b*, the first contacting part 72*a* hits the inclined surface, and thus the first contacting part 72*a* is guided to the depth side of the recess 47 and the center of the recess 47. In this manner, the setting members 71*a* and 71*b* can be smoothly mounted on the mounting units 41*a* and 41*b*.

(12) When the drying device 51 is not mounted on the recording device 11, the recess 47 is closed with the upper opening-closing member 27 and the lower opening-closing member 28. In addition, the detection units 43*a* and 43*b* that detect the mounted setting members 71*a* and 71*b* are disposed on the depth side of the recess 47. In this manner, it is possible to prevent a situation where the user mistakenly touches the detection units 43*a* and 43*b* in the recess 47 and the detection units 43*a* and 43*b* are brought into the detection state.

(13) By adjusting the angle of the heat dissipation surface 55*a* with respect to the floor surface 101 in the drying device 51, the drying device 51 can be used also for the recording device 11 whose support surface 25*a* has a different angle with respect to the floor surface 101. By adjusting the height of the heat dissipation surface 55*a* with respect to the floor surface 101 in the drying device 51, the drying device 51 can be used also for the recording device 11 whose support surface 25*a* has a different height with respect to the floor surface 101.

(14) The drying device 51 includes a plurality of casters 53*a*. When mounting the setting members 71*a* and 71*b* to the mounting units 41*a* and 41*b*, the user moves the drying device 51 in the direction in which the drying device 51 approaches the recording device 11, on the floor surface 101. The roller of the caster 53*a* rotates on the floor surface 101, and thus the drying device 51 can be easily brought closer to the recording device 11.

Second Embodiment

A second embodiment is described below with reference to the accompanying drawings. The second embodiment is substantially the same as the first embodiment, and therefore overlapping descriptions will be omitted by denoting the same configurations with the same reference numerals.

Configuration of Recording System

Figure 8:
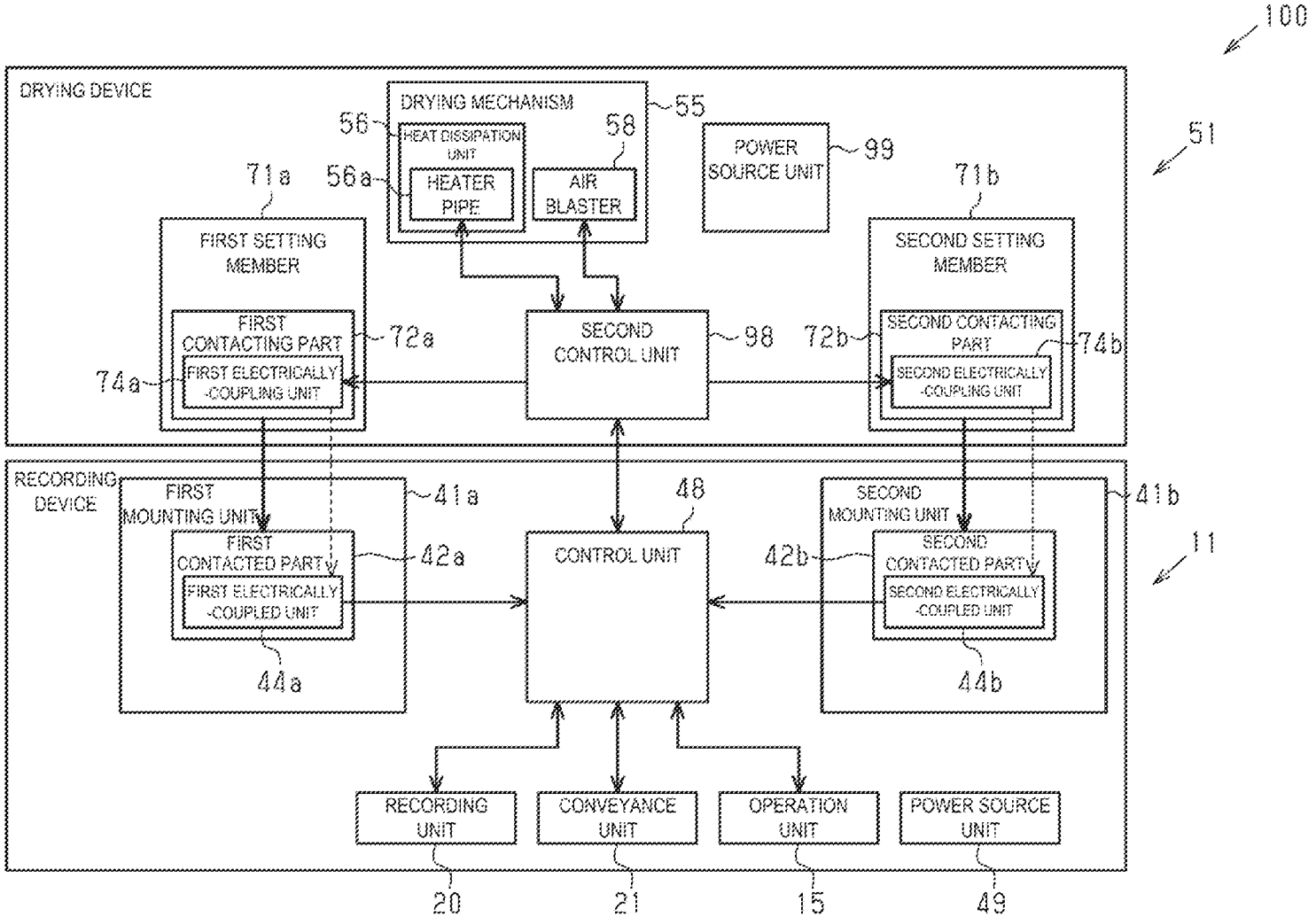
FIG. 8 is a block diagram illustrating a configuration of the recording system according to the second embodiment.

As illustrated in FIG. 8, the first contacting part 72*a* includes a first electrically-coupling unit 74*a* that is electrically coupled with the first contacted part 42*a*. The first contacted part 42*a* includes a first electrically-coupled unit 44*a* that is electrically coupled with the first contacting part 72*a*. The second contacting part 72*b* includes a second electrically-coupling unit 74*b* that is electrically coupled with the second contacted part 42*b*. The second contacted part 42*b* includes a second electrically-coupled unit 44*b* that is electrically coupled with the second contacting part 72*b*. The control unit 48 and the second control unit 98 are connected to each other through a connection cable (not illustrated in the drawing) that connects the recording device 11 and the drying device 51.

The first electrically-coupling unit 74*a* is connected to the second control unit 98. The first electrically-coupled unit 44*a* is connected to the control unit 48. The control unit 48 and the second control unit 98 are connected to each other through a connection cable (not illustrated in the drawing). When the first contacting part 72*a* makes contact with the first contacted part 42*a*, the first spacing Sa illustrated in FIG. 3 is set to a predetermined spacing. Further, through the contact between the first contacting part 72*a* and the first contacted part 42*a*, the first electrically-coupling unit 74*a* and the first electrically-coupled unit 44*a* make contact with each other, and thus a current flows through the closed electric circuit. More specifically, a current flows from the control unit 48 to the control unit 48 via a connection cable (not illustrated in the drawing), the second control unit 98, the first electrically-coupling unit 74*a*, and the first electrically-coupled unit 44*a*. That is, through the contact between the first contacting part 72*a* and the first contacted part 42*a*, the first electrically-coupling unit 74*a* is electrically coupled with the first electrically-coupled unit 44*a*.

The second electrically-coupling unit 74*b* is connected to the second control unit 98. The second electrically-coupled unit 44*b* is connected to the control unit 48. The control unit 48 and the second control unit 98 are connected to each other through a connection cable (not illustrated in the drawing). When the second contacting part 72*b* makes contact with the second contacted part 42*b*, the second spacing Sb illustrated in FIG. 3 is set to a predetermined spacing. Then, through the contact between the second contacting part 72*b* and the second contacted part 42*b*, the second electrically-coupling unit 74*b* and the second electrically-coupled unit 44*b* make contact with each other, and thus a current flows through the closed electric circuit. More specifically, a current flows from the control unit 48 to the control unit 48 via a connection cable (not illustrated in the drawing), the second control unit 98, the second electrically-coupling unit 74*b*, and the second electrically-coupled unit 44*b*. That is, through the contact between the second contacting part 72*b* and the second contacted part 42*b*, the second electrically-coupling unit 74*b* is electrically coupled with the second electrically-coupled unit 44*b*.

When the first electrically-coupling unit 74*a* is electrically coupled with the first electrically-coupled unit 44*a*, the control unit 48 detects the conduction between the first electrically-coupling unit 74*a* and the first electrically-coupled unit 44*a*. That is, when the first electrically-coupling unit 74*a* is electrically coupled with the first electrically-coupled unit 44*a*, the control unit 48 detects the fact that the first spacing Sa illustrated in FIG. 3 is set to a predetermined spacing.

When the second electrically-coupling unit 74*b* is electrically coupled with the second electrically-coupled unit 44*b*, the control unit 48 detects the conduction of the second electrically-coupling unit 74*b* and the second electrically-coupled unit 44*b*. That is, when the second electrically-coupling unit 74*b* is electrically coupled with the second electrically-coupled unit 44*b*, the control unit 48 detects the fact that the second spacing Sb illustrated in FIG. 3 is set to a predetermined spacing.

When the first electrically-coupling unit 74*a* is electrically coupled with the first electrically-coupled unit 44*a*, and the second electrically-coupling unit 74*b* is electrically coupled with the second electrically-coupled unit 44*b*, the drying mechanism 55 functions. When at least one of the first electrically-coupling unit 74*a* and the second electrically-coupling unit 74*b* ceases conduction, the function of the drying mechanism 55 stops. That is, when the first spacing Sa illustrated in FIG. 3 is set to a predetermined spacing by the first setting member 71*a*, and the second spacing Sb illustrated in FIG. 3 is set to a predetermined spacing by the second setting member 71*b*, the control unit 48 of the recording device 11 causes the drying mechanism 55 to function. When the setting of at least one of the first setting member 71*a* and the second setting member 71*b* is released, the control unit 48 of the recording device 11 stops the function of the drying mechanism 55.

Configuration of Mounting Unit

Figure 9:
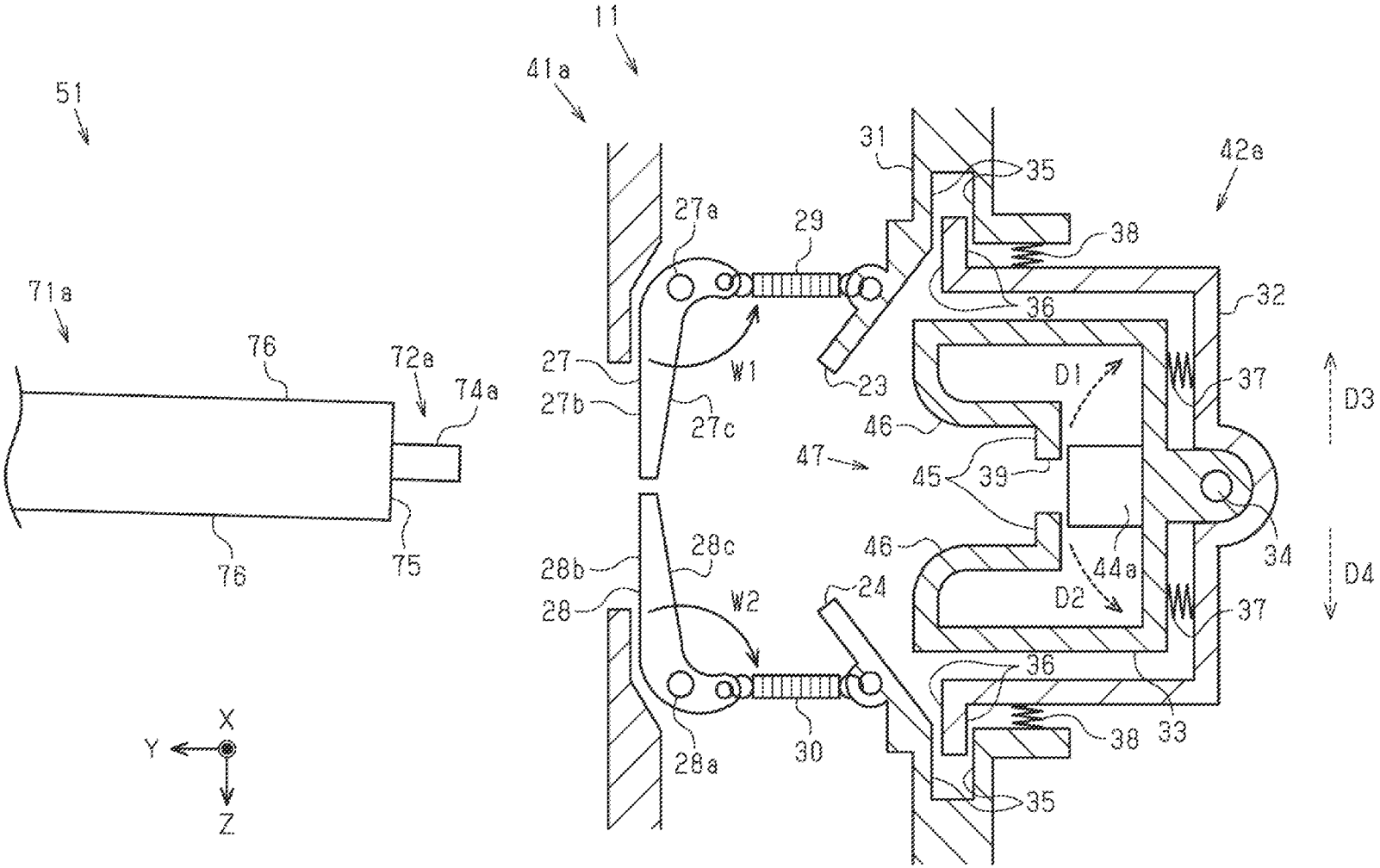
FIG. 9 is a schematic sectional view illustrating a setting member and a mounting unit according to the second embodiment.

As illustrated in FIG. 9, the first contacting part 72*a* is composed of the contacting surface 75 that makes contact with the first mounting unit 41*a*, and the first electrically-coupling unit 74*a* protruding at a center portion on the contacting surface 75. The first electrically-coupling unit 74*a* is, for example, a male connector.

The tilting unit 33 includes a recess 47 at the center of the surface that faces the contacting surface 75 of the first setting member 71*a*. The recess 47 has a shape in which a hole 39 is open at the center of the bottom surface of a flare-shaped hole portion. In other words, the recess 47 is composed of a flare-shaped guiding surface 46 as the side surface of the hole portion, and the contact surface 45 as the bottom surface of the hole portion. The guiding surface 46 is formed in a shape in which the entrance side of the hole slightly flares out. In other words, the guiding surface 46 includes an inclined surface on the entrance side of the recess 47, and a columnar hole-shaped portion on the depth side of the recess 47. The columnar shaped guided surface 76 and the columnar hole-shaped portion in the guiding surface 46 are formed in sizes that can fit with each other. On the depth side of the hole 39, the first electrically-coupled unit 44*a* is disposed. The first electrically-coupled unit 44*a* is, for example, a female connector. When the first setting member 71*a* is mounted, the first electrically-coupling unit 74*a*, which is a male connector, protrudes from the hole 39.

Note that the configurations of the second setting member 71*b* and the second mounting unit 41*b* are the same as the configurations of the first setting member 71*a* and the first mounting unit 41*a*. Therefore, the description of the configurations of the second setting member 71*b* and the second mounting unit 41*b* will be omitted.

Mounting Operation

Figure 10:
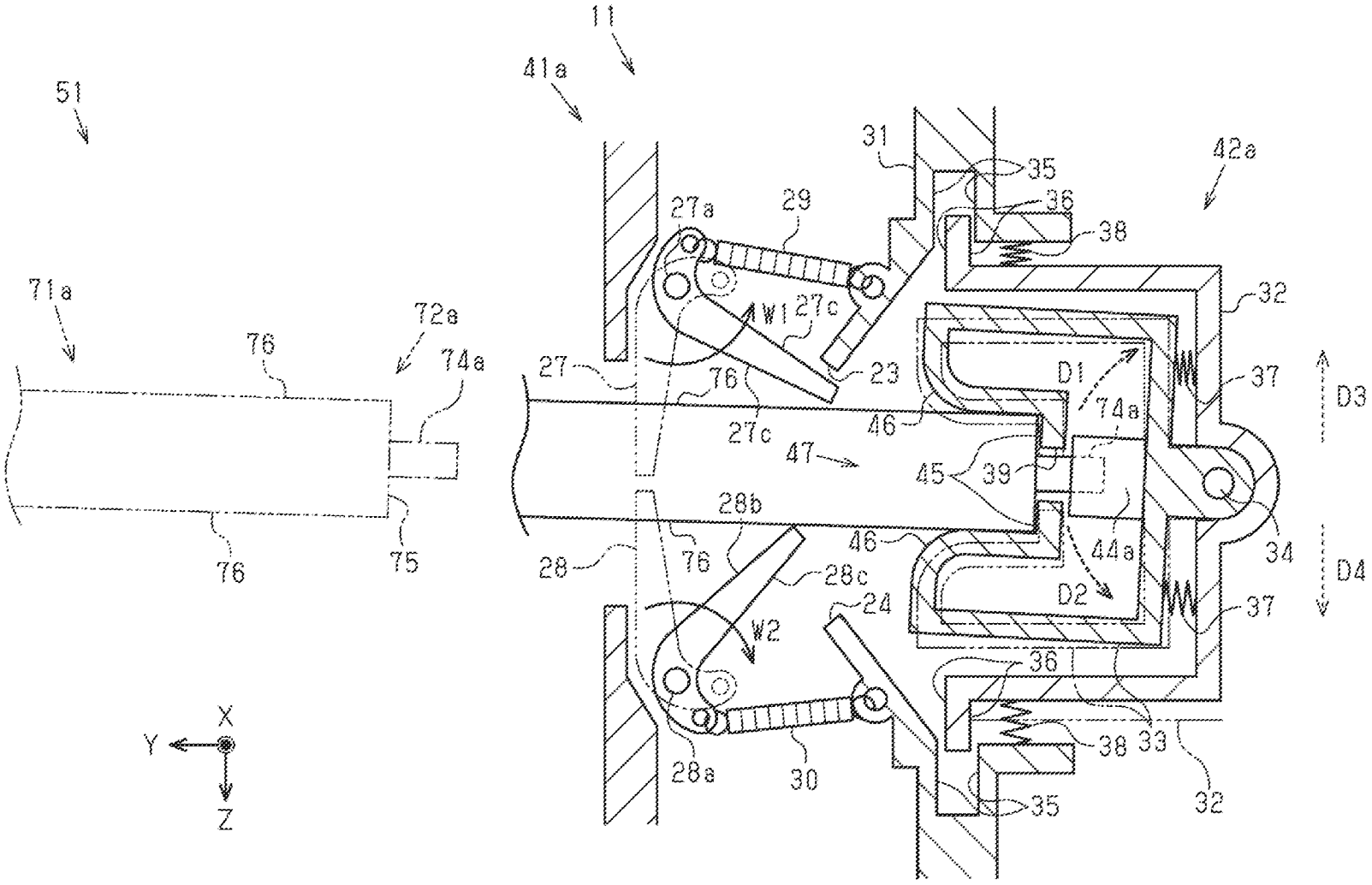
FIG. 10 is a schematic sectional view illustrating a state where the setting member is mounted on the mounting unit according to the second embodiment.

As illustrated in FIG. 10, when the first contacting part 72*a* is inserted to the first contacted part 42*a*, the first electrically-coupled unit 44*a* of the first contacting part 72*a* protrudes from the hole 39 of the recess 47. Then, when the contacting surface 75 of the first contacting part 72*a* makes contact with the contact surface 45 of the first contacted part 42*a*, the first electrically-coupled unit 44*a* disposed on the depth side of the hole 39 is electrically coupled with the first electrically-coupling unit 74*a* protruded from the hole 39. That is, when the first electrically-coupled unit 44*a*, which is a male connector, and the first electrically-coupling unit 74*a*, which is a male connector, are connected to each other, a current flows through the closed electric circuit. In this manner, the control unit 48 detects the contact between the contacting surface 75 and the contact surface 45.

The contacting surface 75 and the contact surface 45 may not be provided. Even in the case where the contacting surface 75 and the contact surface 45 are not provided, the first electrically-coupled unit 44*a* is electrically coupled with the first electrically-coupling unit 74*a* when the first setting member 71*a* is mounted on the first mounting unit 41*a*. However, it is desirable that when the first setting member 71*a* is pushed into the first mounting unit 41*a*, the contact surface 45 make contact with the contacting surface 75 so as to receive the direct force from the contacting surface 75 at the contact surface 45, rather than at the connecting portion of the connector.

Note that the configurations of the second setting member 71*b* and the second mounting unit 41*b* are the same as the configurations of the first setting member 71*a* and the first mounting unit 41*a*. Therefore, the description of the operations performed at the second mounting unit 41*b* when the second setting member 71*b* is mounted on the second mounting unit 41*b* will be omitted.

Operation of Embodiment

Operations of this embodiment will be described below. The second embodiment is substantially the same as the first embodiment, and therefore the overlapping description for the operation will also be omitted.

When the first contacting part 72*a* is pushed into the recess 47, the contacting surface 75 of the first contacting part 72*a* makes contact with the contact surface 45 of the first contacted part 42*a*. Through this contact, the first electrically-coupled unit 44*a* disposed on the depth side of the hole 39 is electrically coupled with the first electrically-coupling unit 74*a* protruded from the hole 39. That is, when the first electrically-coupled unit 44*a* is electrically coupled with the first electrically-coupling unit 74*a*, the control unit 48 detects the contact between the contacting surface 75 of the first contacting part 72*a* and the contact surface 45.

At the first mounting unit 41*a*, the first spacing Sa is set to a predetermined spacing by the first setting member 71*a* when the contacting surface 75 makes contact with the contact surface 45. Through the conduction between the first electrically-coupled unit 44*a* and the first electrically-coupling unit 74*a*, the control unit 48 can detect the fact that the first spacing Sa is set to a predetermined spacing by the first setting member 71*a*.

In this state, the first spacing Sa is set to a predetermined spacing by the first setting member 71*a*, but the second spacing Sb has not yet been set to a predetermined spacing by the second setting member 71*b*. Therefore, the control unit 48 does not cause the drying mechanism 55 to function. Specifically, the drying device 51 can be prevented from functioning when the drying device 51 is not mounted in the state where the recording device 11 and the drying device 51 are in an appropriate positional relationship.

In this state, when the second contacting part 72*b* is further pushed into the recess 47, the contacting surface 75 of the second contacting part 72*b* makes contact with the contact surface 45 of the second contacted part 42*b*. Through this contact, the second electrically-coupled unit 44*b* disposed on the depth side of the hole 39 is electrically coupled with the second electrically-coupling unit 74*b* protruded from the hole 39. That is, when the second electrically-coupled unit 44*b* is electrically coupled with the second electrically-coupling unit 74*b*, the control unit 48 detects contact between the contacting surface 75 of the second contacting part 72*b* and the contact surface 45.

At the second mounting unit 41*b*, when the contacting surface 75 makes contact with the contact surface 45, and the second spacing Sb is set to a predetermined spacing by the second setting member 71*b*. Through the conduction between the second electrically-coupled unit 44*b* and the second electrically-coupling unit 74*b*, the control unit 48 can detect the fact that the second spacing Sb is set to a predetermined spacing by the second setting member 71*b*.

In this state, the first spacing Sa is set to a predetermined spacing by the first setting member 71*a*, and the second spacing Sb is set to a predetermined spacing by the second setting member 71*b*. In addition, with the first setting member 71*a* and the second setting member 71*b*, the position of the drying mechanism 55 in the second conveyance direction Y2 is set to a predetermined position on the support surface 25*a*. In this state, the control unit 48 causes the drying mechanism 55 to function. Specifically, the drying device 51 can be allowed to function when the drying device 51 is mounted in the state where the recording device 11 and the drying device 51 are in an appropriate positional relationship. The user fixes the position of the drying device 51 by locking the roller of the caster 53*a*.

Effect of Embodiment

Effects of this embodiment will be described below.

With the recording system 100 and the drying device 51 of this embodiment, the same effects as (1), (2), (4) to (11), (13) and (14) of the first embodiment are obtained.

(15) The first electrically-coupling unit 74*a* is electrically coupled with the first electrically-coupled unit 44*a* through contact between the first contacting part 72*a* and the first contacted part 42*a*, and the second electrically-coupling unit 74*b* is electrically coupled with the second electrically-coupled unit 44*b* through contact between the second contacting part 72*b* and the second contacted part 42*b*. When the recording device 11 is electrically coupled with the drying device 51, the circuit for detecting the contact is formed. That is, when the setting by the contact is released, the circuit for detecting the contact is short-circuited, and thus the function of the drying device 51 can be reliably stopped.

Third Embodiment

A third embodiment will be described below with reference to the accompanying drawings. The third embodiment are substantially the same as the first embodiment and the second embodiment, and therefore overlapping descriptions will be omitted by denoting the same configurations with the same reference numerals.

Configuration of Recording System

Figure 11:
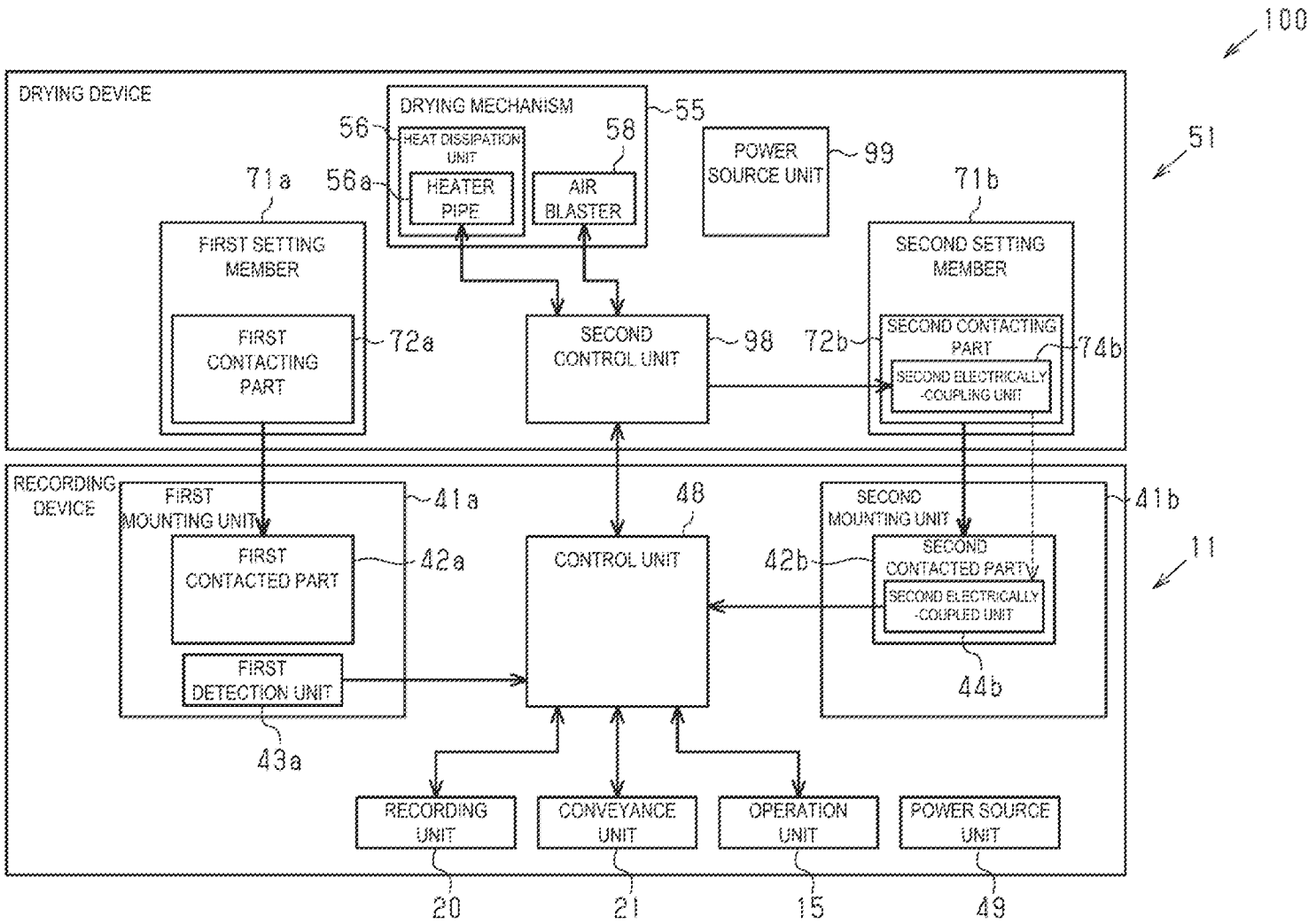
FIG. 11 is a block diagram illustrating a configuration of the recording system according to the third embodiment.

As illustrated in FIG. 11, the recording system 100 includes the first detection unit 43*a* that detects contact between the first contacting part 72*a* and the first contacted part 42*a*. The notification of the detection result of the first detection unit 43*a* is provided to the control unit 48. When the first contacting part 72*a* makes contact with the first contacted part 42*a*, the first spacing Sa illustrated in FIG. 3 is set to a predetermined spacing.

The second contacting part 72*b* includes a second electrically-coupling unit 74*b* that is electrically coupled with the second contacted part 42*b*. The second contacted part 42*b* includes a second electrically-coupled unit 44*b* that is electrically coupled with the second contacting part 72*b*. The control unit 48 and the second control unit 98 are connected to each other through a connection cable (not illustrated in the drawing) that connects the recording device 11 and the drying device 51.

The second electrically-coupling unit 74*b* is connected to the second control unit 98. The second electrically-coupled unit 44*b* is connected to the control unit 48. The control unit 48 and the second control unit 98 are connected to each other through a connection cable (not illustrated in the drawing). When the second contacting part 72*b* makes contact with the second contacted part 42*b*, the second spacing Sb illustrated in FIG. 3 is set to a predetermined spacing. Then, through the contact between the second contacting part 72*b* and the second contacted part 42*b*, the second electrically-coupling unit 74*b* and the second electrically-coupled unit 44*b* make contact with each other, and thus a current flows through the closed electric circuit. More specifically, a current flows from the control unit 48 to the control unit 48 via a connection cable (not illustrated in the drawing), the second control unit 98, the second electrically-coupling unit 74*b*, and the second electrically-coupled unit 44*b*. That is, through the contact between the second contacting part 72*b* and the second contacted part 42*b*, the second electrically-coupling unit 74*b* is electrically coupled with the second electrically-coupled unit 44*b*.

When the second electrically-coupling unit 74*b* is electrically coupled with the second electrically-coupled unit 44*b*, the control unit 48 detects the conduction of the second electrically-coupling unit 74*b* and the second electrically-coupled unit 44*b*. That is, when the second electrically-coupling unit 74*b* is electrically coupled with the second electrically-coupled unit 44*b*, the control unit 48 detects the fact that the second spacing Sb illustrated in FIG. 3 is set to a predetermined spacing.

When the first detection unit 43*a* detects contact between the first contacting part 72*a* and the first contacted part 42*a* and the second electrically-coupling unit 74*b* is electrically coupled with the second electrically-coupled unit 44*b*, the drying mechanism 55 functions. Then, the function of the drying mechanism 55 stops in at least one of the following cases: a case where the first detection unit 43*a* stops the detection of the contact, and a case where the second electrically-coupling unit 74*b* ceases conduction. That is, when the first spacing Sa illustrated in FIG. 3 is set to a predetermined spacing by the first setting member 71*a*, and the second spacing Sb illustrated in FIG. 3 is set to a predetermined spacing by the second setting member 71*b*, the control unit 48 of the recording device 11 causes the drying mechanism 55 to function. When the setting of at least one of the first setting member 71*a* and the second setting member 71*b* is released, the control unit 48 of the recording device 11 stops the function of the drying mechanism 55.

Operation of Embodiment

Operations of this embodiment will be described below. The third embodiment is substantially the same as the first embodiment and the second embodiment, and therefore the overlapping description for the operation will also be omitted.

When the first contacting part 72*a* is pushed into the recess 47, the contacting surface 75 of the first contacting part 72*a* makes contact with the contact surface 45 of the first contacted part 42*a*. Through this contact, the first detection unit 43*a* disposed on the depth side of the hole 39 detects the detection target part 73 protruded from the hole 39.

At the first mounting unit 41*a*, the first spacing Sa is set to a predetermined spacing by the first setting member 71*a* when the contacting surface 75 makes contact with the contact surface 45. From the detection result of the first detection unit 43*a*, the control unit 48 can detect the fact that the first spacing Sa is set to a predetermined spacing by the first setting member 71*a*.

In this state, the first spacing Sa is set to a predetermined spacing by the first setting member 71*a*, but the second spacing Sb has not yet been set to a predetermined spacing by the second setting member 71*b*. Therefore, the control unit 48 does not cause the drying mechanism 55 to function. Specifically, the drying device 51 can be prevented from functioning when the drying device 51 is not mounted in the state where the recording device 11 and the drying device 51 are in an appropriate positional relationship.

In this state, when the second contacting part 72*b* is further pushed into the recess 47, the contacting surface 75 of the second contacting part 72*b* makes contact with the contact surface 45 of the second contacted part 42*b*. Through this contact, the second electrically-coupled unit 44*b* disposed on the depth side of the hole 39 is electrically coupled with the second electrically-coupling unit 74*b* protruded from the hole 39. That is, when the second electrically-coupled unit 44*b* is electrically coupled with the second electrically-coupling unit 74*b*, the control unit 48 detects contact between the contacting surface 75 of the second contacting part 72*b* and the contact surface 45.

At the second mounting unit 41*b*, when the contacting surface 75 makes contact with the contact surface 45, and the second spacing Sb is set to a predetermined spacing by the second setting member 71*b*. Through the conduction between the second electrically-coupled unit 44*b* and the second electrically-coupling unit 74*b*, the control unit 48 can detect the fact that the second spacing Sb is set to a predetermined spacing by the second setting member 71*b*.

In this state, the first spacing Sa is set to a predetermined spacing by the first setting member 71*a*, and the second spacing Sb is set to a predetermined spacing by the second setting member 71*b*. In addition, with the first setting member 71*a* and the second setting member 71*b*, the position of the drying mechanism 55 in the second conveyance direction Y2 is set to a predetermined position on the support surface 25*a*. In this state, the control unit 48 causes the drying mechanism 55 to function. Specifically, the drying device 51 can be allowed to function when the drying device 51 is mounted in the state where the recording device 11 and the drying device 51 are in an appropriate positional relationship. The user fixes the position of the drying device 51 by locking the roller of the caster 53*a*.

The position of the drying device 51 may move when the drying device 51 is pushed due to an unexpected contact between the user and the housing 52 of the drying device 51 and the surface of the locked roller of the caster 53*a* slips on the floor surface 101. As a result, for example, when the contacting surface 75 of the second setting member 71*b* is separated from the contact surface 45, the second electrically-coupled unit 44*b* and the second electrically-coupling unit 74*b* cease the conduction with. That is, the second electrically-coupled unit 44*b* and the second electrically-coupling unit 74*b* are short-circuited. At this time, through the short-circuit of the second electrically-coupled unit 44*b* and the second electrically-coupling unit 74*b*, the control unit 48 can detect the fact that the setting by the second setting member 71*b* has been released.

Effect of Embodiment

Effects of this embodiment will be described below.

With the recording system 100 and the drying device 51 of this embodiment, the same effects as (1), (2), (4) to (11), (13) and (14) of the first embodiment are obtained.

(16) The recording system 100 includes the first detection unit 43*a* that detects contact between the first contacting part 72*a* and the first contacted part 42*a*, and the second electrically-coupling unit 74*b* is electrically coupled with the second electrically-coupled unit 44*b* through contact between the second contacting part 72*b* and the second contacted part 42*b*. Of the recording device 11 and the drying device 51, only the device that includes the first detection unit 43*a* forms the circuit for detecting the contact, on the first setting member 71*a* side. In addition, on the second setting member 71*b* side, both the recording device 11 and the drying device 51 form the circuit for detecting the contact through a conduction between the recording device 11 and the drying device 51. With the recording system 100 including the two different circuits for detecting the contact, the frequency of simultaneous occurrence of a detection defect on the first setting member 71*a* side and a detection defect on the second setting member 71*b* side can be reduced.

Modification of Embodiment

The embodiments may be modified as follows. The embodiments and the following modifications may be combined with each other to the extent that they are not technically contradictory.

The number of the mounting units 41 and the number of the setting members 71 may be one each. For example, in FIG. 1, the recording device 11 may include one mounting unit 41 at a position on the lower side of the roll R and at an approximately center in the width direction X of the recording medium M. In addition, the drying device 51 may include one setting member 71 at a position facing that mounting unit 41.

In addition, the drying device 51 may include one setting member 71 at a position facing that mounting unit 41. In addition to the two mounting units 41*a* and 41*b* of the first embodiment and the two setting members 71*a* and 71*b* of the first embodiment, the recording device 11 may include another one mounting unit 41 at a position on the lower side of the roll R and at approximately center in the width direction X of the recording medium M. In addition, the drying device 51 may include another setting member 71 at a position facing that mounting unit 41. With the three setting members 71, the position of the drying device 51 can be set such that the spacing S between the drying mechanism 55 and the support surface 25*a* is uniform not only in the width direction X of the recording medium M, but also in the second conveyance direction Y2.

In the second embodiment, a power line for heating the drying mechanism 55 may be conducted from the first electrically-coupling unit 74*a* to the first electrically-coupled unit 44*a*, and this power line may be further conducted from the second electrically-coupling unit 74*b* to the second electrically-coupled unit 44*b*. In this manner, power is supplied to the drying mechanism 55 when the first spacing Sa is set to a predetermined spacing by the first setting member 71*a* and the second spacing Sb is set to a predetermined spacing by the second setting member 71*b*. More specifically, the drying mechanism 55 functions when power is supplied from the power source unit 99 to the drying mechanism 55 via the first electrically-coupling unit 74*a*, the first electrically-coupled unit 44*a*, the second electrically-coupled unit 44*b*, and the second electrically-coupling unit 74*b*. Then, when at least one of the first electrically-coupling unit 74*a* and the second electrically-coupling unit 74*b* is short-circuited, the power supply from the power source unit 99 to the drying mechanism 55 stops, and thus the function of the drying mechanism 55 stops.

In the second embodiment, the first electrically-coupling unit 74*a* and the second electrically-coupling unit 74*b* may be directly connected to each other, without the second control unit 98 interposed therebetween. Further, the first electrically-coupled unit 44*a* is connected to the control unit 48, and the second electrically-coupled unit 44*b* is connected to the control unit 48. Further, through the contact between the first contacting part 72*a* and the first contacted part 42*a*, the first electrically-coupling unit 74*a* and the first electrically-coupled unit 44*a* make contact with each other. Further, through contact between the second contacting part 72*b* and the second contacted part 42*b*, the second electrically-coupling unit 74*b* and the second electrically-coupled unit 44*b* make contact with each other. In this manner, a current flows through the closed electric circuit. More specifically, a current flows from the control unit 48 to the control unit 48 via the first electrically-coupled unit 44*a*, the first electrically-coupling unit 74*a*, the second electrically-coupling unit 74*b*, and the second electrically-coupled unit 44*b*. In this manner, the control unit 48 may detect the fact that the first electrically-coupling unit 74*a* is electrically coupled with the first electrically-coupled unit 44*a*, and that the second electrically-coupling unit 74*b* is electrically coupled with the second electrically-coupled unit 44*b*.

In the second embodiment, the first electrically-coupled unit 44*a* and the second electrically-coupled unit 44*b* may be directly connected to each other without the control unit 48 interposed therebetween. Further, the first electrically-coupling unit 74*a* is connected to the second control unit 98, and the second electrically-coupling unit 74*b* is connected to the second control unit 98. Further, through the contact between the first contacting part 72*a* and the first contacted part 42*a*, the first electrically-coupling unit 74*a* and the first electrically-coupled unit 44*a* make contact with each other. Further, through contact between the second contacting part 72*b* and the second contacted part 42*b*, the second electrically-coupling unit 74*b* and the second electrically-coupled unit 44*b* make contact with each other. In this manner, a current flows through the closed electric circuit. More specifically, a current flows from the second control unit 98 to the second control unit 98 via the first electrically-coupling unit 74*a*, the first electrically-coupled unit 44*a*, the second electrically-coupled unit 44*b*, and the second electrically-coupling unit 74*b*. In this manner, the second control unit 98 may detect the fact that the first electrically-coupling unit 74*a* is electrically coupled with the first electrically-coupled unit 44*a*, and that the second electrically-coupling unit 74*b* is electrically coupled with the second electrically-coupled unit 44*b*. Further, the second control unit 98 may provide the notification of that result to the control unit 48.

In the second embodiment, one of the recording device 11 and the drying device 51 may include the first detection unit 43*a* that detects contact between the first contacting part 72*a* and the first contacted part 42*a*. For example, when the first setting member 71*a* is mounted, the detection target part 73 and the first electrically-coupling unit 74*a* are protruded from the hole 39. On the depth side of the hole 39, the first detection unit 43*a* and the first electrically-coupled unit 44*a* are disposed side by side. The first detection unit 43*a* detects the detection target part 73 protruded from the hole 39, and the first electrically-coupling unit 74*a* is electrically coupled with the first electrically-coupled unit 44*a*. Further, the detection of the contact on the first setting member 71*a* side may be performed through both the conduction between the first electrically-coupling unit 74*a* and the first electrically-coupled unit 44*a*, and the first detection unit 43*a*. In this manner, the reliability of the detection on the first setting member 71*a* side can be increased.

In the second embodiment, one of the recording device 11 and the drying device 51 may include the second detection unit 43*b* that detects contact between the second contacting part 72*b* and the second contacted part 42*b*. For example, when the second setting member 71*b* is mounted, the detection target part 73 and the second electrically-coupling unit 74*b* are protruded from the hole 39. On the depth side of the hole 39, the second detection unit 43*b* and the second electrically-coupled unit 44*b* are disposed side by side. The second detection unit 43*b* detects the detection target part 73 protruded from the hole 39, and the second electrically-coupling unit 74*b* is electrically coupled with the second electrically-coupled unit 44*b*. Further, the detection of the contact on the second setting member 71*b* side may be performed through both the conduction of the second electrically-coupling unit 74*b* and the second electrically-coupled unit 44*b*, and the second detection unit 43*b*. In this manner, the reliability of the detection on the second setting member 71*b* side can be increased.

The drying mechanism 55 may be a drying mechanism including only a heating mechanism. In this case, "drying mechanism functions" means that heat generation of the heater pipe 56*a* is started when the energization to the heater pipe 56*a* is started. The "the function of the drying mechanism stops" means that heat generation of the heater pipe 56*a* is stopped when the energization to the heater pipe 56*a* is stopped. Even with the drying mechanism including only the heating mechanism, the recording medium M can be dried in an appropriate state by setting the spacing S between the support surface 25*a* and the drying mechanism 55 by the setting member 71.

The drying mechanism 55 may include a drying mechanism including only an air blasting mechanism. In this case, "drying mechanism functions" means that the rotation of the air blaster 58 is started. The "the function of the drying mechanism stops" means that the rotation of the air blaster 58 is stopped. Even with the drying mechanism including only the air blasting mechanism, the recording medium M can be dried in an appropriate state by setting the spacing S between the support surface 25*a* and the drying mechanism 55 to a predetermined spacing by the setting member 71.

The first mounting unit 41*a* and the second mounting unit 41*b* may include only one of the upper opening-closing member 27 and the lower opening-closing member 28. The first setting member 71*a* and the second setting member 71*b* can be easily mounted on the first mounting unit 41*a* and the second mounting unit 41*b*, and a situation where the first detection unit 43*a* and the second detection unit 43*b* in the recess 47 are mistakenly brought into the detection state can be reduced.

Technical Ideas Grasped from Embodiments and Modifications, and Operational Effects of the Same Technical ideas grasped from the embodiments and the modifications, and operational effects of the same are described below.

(A) A recording system includes a recording device and a drying device, the recording device including a recording unit configured to perform recording by applying liquid to a recording medium conveyed in a conveyance direction, the drying device including a drying mechanism configured to dry the recording medium to which the liquid is applied. the recording device includes a support surface configured to support the recording medium and provided downstream of the recording unit in the conveyance direction, the device is configured to be mounted on the recording device at a position where the support surface and the drying mechanism face each other, one of the recording device and the drying device includes a setting member configured to set a spacing between the support surface and the drying mechanism to a predetermined spacing when the drying device is mounted on the recording device, the drying mechanism functions when the spacing is set to the predetermined spacing by the setting member, and a function of the drying mechanism stops when the setting by the setting member is released.

With this configuration, when the spacing between the support surface and the drying mechanism is set to a predetermined spacing by the setting member, the surface to which the liquid is applied in the recording medium on the support surface that supports the recording medium, and the drying mechanism have an appropriate positional relationship. With the drying mechanism that functions when the spacing between the support surface and the drying mechanism is set to a predetermined spacing, the recording medium can be dried in an appropriate state. In addition, when the setting by the setting member is released, the surface to which the liquid is applied in the recording medium on the support surface that supports the recording medium, and the drying mechanism do not have an appropriate positional relationship. With the drying mechanism whose function stops when the setting by the setting member is released, a situation where the drying mechanism functions in the state where the recording medium is not appropriately dried can be reduced.

(B) The recording system may be configured to such that the recording system includes a plurality of the setting members, the spacings at a plurality of locations is set to a predetermined spacing by the plurality of setting members, the drying mechanism functions when all of the spacings of the plurality of locations are set to the predetermined spacing, and the function of the drying mechanism stops when the setting by at least one of the plurality of setting members is released.

With this configuration, with the plurality of setting members, when all of the spacings of the plurality of locations between the support surface and the drying mechanism are set to a predetermined spacing, the entire surface to be dried in the recording medium and the entire surface for drying the recording medium in the drying mechanism have an appropriate positional relationship. With the drying mechanism that functions when all of the spacings at the plurality of locations are set to a predetermined spacing, the entire surface to be dried in the recording medium can be dried in an appropriate state. In addition, when the setting by at least one of the plurality of setting members is released, at least a part of the entire surface to be dried does not having an appropriate positional relationship. With the drying mechanism whose function stops when the setting by at least one setting member of the plurality of spacings is released, a situation where the drying mechanism functions in the state where at least a part of the entire surface to be dried is not appropriately dried can be reduced.

(C) The recording system may be configured to such that the recording system includes a first setting member as the setting member, and a second setting member as the setting member, the first setting member is provided on one external side of a conveyance range of the recording medium in a width direction of the recording medium, the second setting member is provided on the other external side of the conveyance range of the recording medium in the width direction of the recording medium, the drying mechanism functions when a first spacing as the spacing on the one side is set to a predetermined spacing by the first setting member, and a second spacing as the spacing on the other side is set to a predetermined spacing by the second setting member, and the function of the drying mechanism stops when the setting by at least one of the first setting member and the second setting member is released.

With this configuration, the first spacing on one external side of the conveyance range of the recording medium in the width direction of the recording medium is set to a predetermined spacing by the first setting member. In this manner, on one side, the surface to be dried in the recording medium and the surface for drying the recording medium in the drying mechanism have an appropriate positional relationship. In addition, the second spacing on the other external side of the conveyance range of the recording medium in the recording medium width direction is set to a predetermined spacing by the second setting member. In this manner, on the other side, the surface to be dried in the recording medium and the surface for drying the recording medium in the drying mechanism have an appropriate positional relationship. That is, with the first setting member and the second setting member, the surface to be dried in the recording medium and the surface for drying the recording medium in the drying mechanism have an appropriate positional relationship from one side to the other side in the width direction of the recording medium. The drying mechanism functions when the first spacing on one side is set to a predetermined spacing by the first setting member, and the second spacing on the other side is set to a predetermined spacing by the second setting member. In this manner, the recording medium can be dried in an appropriate state from one side to the other side. In addition, when the setting by at least one of the first setting member and the second setting member is released, the function of the drying mechanism stops. In this manner, a situation where the drying mechanism functions in the state where the surface of the recording medium on one of the sides in the width direction of the recording medium is not appropriately dried can be suppressed.

(D) The recording system may be configured to such that one of the recording device and the drying device includes the first setting member, the first setting member includes a first contacting part configured to make contact with the other of the recording device and the drying device, the other of the recording device and the drying device includes a first contacted part configured to be brought into contact with the first contacting part, one of the recording device and the drying device includes the second setting member, the second setting member includes a second contacting part configured to make contact with the other of the recording device and the drying device, the other of the recording device and the drying device includes a second contacted part configured to be brought into contact with the second contacting part, the first spacing is set to a predetermined spacing by the first contacting part making contact with the first contacted part, the second spacing is set to a predetermined spacing by the second contacting part making contact with the second contacted part.

With this configuration, when the first contacting part of the first setting member makes contact with the first contacted part, the first spacing is set to a predetermined spacing. Since the positional relationship is uniformly determined through the hitting of the members against each other, the first spacing can be reliably set to a predetermined spacing. When the second contacting part of the second setting member makes contact with the second contacted part, the second spacing is set to a predetermined spacing. Since the positional relationship is uniformly determined through the hitting of the members against each other, the second spacing can be reliably set to a predetermined spacing.

(E) The recording system may be configured to such that a first detection unit configured to detect contact between the first contacting part and the first contacted part, and a second detection unit configured to detect contact between the second contacting part and the second contacted part.

With this configuration, of the recording device and the drying device, only the device that includes the first detection unit forms the circuit for the first detection unit to detect the contact. In addition, of the recording device and the drying device, only the device that includes the second detection unit forms the circuit for the second detection unit to detect the contact. That is, since the circuit for detecting the contact is formed with only one of the devices, the configuration of the circuit of the recording system can be simplified.

(F) The recording system may be configured to such that the first contacting part includes a first electrically-coupling unit configured to be electrically coupled with the first contacted part, the first contacted part includes a first electrically-coupled unit configured to be electrically coupled with the first contacting part, the second contacting part includes a second electrically-coupling unit configured to be electrically coupled with the second contacted part, the second contacted part includes a second electrically-coupled unit configured to be electrically coupled with the second contacting part, the first electrically-coupling unit is electrically coupled with the first electrically-coupled unit through contact between the first contacting part and the first contacted part, and the second electrically-coupling unit is electrically coupled with the second electrically-coupled unit through contact between the second contacting part and the second contacted part.

With this configuration, when the recording device is electrically coupled with the drying device, the circuit for detecting the contact is formed. That is, when the setting by the contact is released, the circuit for detecting the contact is short-circuited, and thus the function of the drying device can be reliably stopped.

(G) The recording system may be configured to such that the recording system includes a first detection unit configured to detect contact between the first contacting part and the first contacted part, the second contacting part includes a second electrically-coupling unit configured to be electrically coupled with the second contacted part, the second contacted part includes a second electrically-coupled unit configured to be electrically coupled with the second electrically-coupling unit, and the second electrically-coupling unit is electrically coupled with the second electrically-coupled unit through contact between the second contacting part and the second contacted part.

With this configuration, on the first setting member side, of the recording device and the drying device, only the device that includes the first detection unit forms the circuit for detecting the contact. In addition, on second setting member side, when the recording device is electrically coupled with the drying device, both the recording device and the drying device form the circuit for detecting the contact. With the recording system including two different circuits for detecting the contact, the frequency of simultaneous occurrence of the detection defect on the first setting member side and the detection defect on the second setting member side can be reduced.

(H) The recording system may be configured to such that the recording device and the drying device are installed on a same plane, the support surface extends in a direction that intersects the plane, and the drying device is mounted on the recording device from a direction parallel to the plane by moving the drying device on the plane.

With this configuration, the spacing between the support surface and the drying mechanism can be easily set to a predetermined spacing by mounting the drying device to the recording device from the direction that intersects the support surface while the user moves the drying device on the floor surface, which is an installation surface. In addition, the drying device can be easily separated from the recording device by moving the drying device in the direction away from the recording device.

(I) The recording system may be configured to such that the recording device includes a control unit configured to control the recording system, the control unit causes the drying mechanism to function when the spacing is set to a predetermined spacing by the setting member, and the control unit stops the function of the drying mechanism when the setting by the setting member is released.

With this configuration, by controlling the recording system by the recording device, the drying mechanism of the drying device can be controlled so as to set the surface of the recording medium to an appropriate state. In addition, not only stopping the function of the drying mechanism when there is an abnormality in the drying mechanism, but also stopping the entire recording system, including the recording device, at an appropriate timing can be achieved. That is, by controlling the recording system by the recording device, the recording device and the drying device can be controlled in cooperation with each other.

(J) The recording system may be configured to such that the drying device includes a power source unit configured to supply power to the drying mechanism.

With this configuration, the power is supplied from the power source unit provided in the drying device to the drying mechanism. Therefore, the capacity of the power source of the power source unit provided in the recording device can be reduced by the capacity of the power source required for the power supplied to the drying mechanism. That is, it is possible to prevent more than necessary burden in terms of cost from being put on the user whose does not require the drying device among the users of the recording device.

(K) The recording system may be configured to such that the setting member is configured such that a posture is switchable between a first posture and a second posture, the first posture setting the spacing to a predetermined spacing, the second posture reducing a posture causing a footprint of the setting member to be smaller than the first posture.

With this configuration, when the user does not use the drying device, the drying device can be housed in a narrow place by switching the posture of the drying device to the second posture in which the footprint at the setting member is smaller than in the first posture.

(L) A drying device is configured to be mounted on a recording device, the recording device including a recording unit configured to perform recording by applying liquid to a recording medium conveyed in a conveyance direction, and a support surface configured to support the recording medium downstream in the conveyance direction, the drying device including a drying mechanism configured to dry the recording medium, to which the liquid is applied, at a position facing the support surface when the drying device is mounted on the recording device. The drying device includes a setting member configured to set a spacing between the support surface and the drying mechanism to a predetermined spacing, the drying mechanism functions when the spacing is set to the predetermined spacing by the setting member, and a function of the drying mechanism stops when the setting by the setting member is released.

With this configuration, when the spacing between the support surface and the drying mechanism is set to a predetermined spacing by the setting member, the surface to which the liquid is applied in the recording medium on the support surface that supports the recording medium, and the drying mechanism have an appropriate positional relationship. Therefore, with the drying mechanism that functions when the spacing between the support surface and the drying mechanism is set to a predetermined spacing, the recording medium can be dried in an appropriate state. In addition, when the spacing between the support surface and the drying mechanism is not set to a predetermined spacing by setting member, the surface to which the liquid is applied in the recording medium on the support surface that supports the recording medium, and the drying mechanism do not have an appropriate positional relationship. Therefore, with the drying mechanism whose function stops when the setting by the setting member is released, a situation where the drying mechanism functions in the state where the recording medium is not appropriately dried can be reduced.

What is claimed is:

1. A recording system comprising a recording device and a drying device, the recording device including a recording unit configured to perform recording by applying liquid to a recording medium conveyed in a conveyance direction, the drying device including a drying mechanism configured to dry the recording medium to which the liquid is applied, wherein the recording device includes a support surface configured to support the recording medium and provided downstream of the recording unit in the conveyance direction;

the device is configured to be mounted on the recording device at a position where the support surface and the drying mechanism face each other;

one of the recording device and the drying device includes a setting member configured to set a spacing between the support surface and the drying mechanism to a predetermined spacing when the drying device is mounted on the recording device;

the drying mechanism functions when the spacing is set to the predetermined spacing by the setting member; and a function of the drying mechanism stops when the setting by the setting member is released.

2. The recording system according to claim 1, wherein the recording system includes a plurality of the setting members;

the spacings at a plurality of locations are set to a predetermined spacing by the plurality of setting members;

the drying mechanism functions when all of the spacings at the plurality of locations are set to the predetermined spacing; and the function of the drying mechanism stops when the setting by at least one of the plurality of setting members is released.

3. The recording system according to claim 1, wherein the recording system includes a first setting member as the setting member, and a second setting member as the setting member;

the first setting member is provided on one external side of a conveyance range of the recording medium in a width direction of the recording medium;

the second setting member is provided on the other external side of the conveyance range of the recording medium in the width direction of the recording medium;

the drying mechanism functions when a first spacing as the spacing on the one side is set to a predetermined spacing by the first setting member, and a second spacing as the spacing on the other side is set to a predetermined spacing by the second setting member; and the function of the drying mechanism stops when the setting by at least one of the first setting member and the second setting member is released.

4. The recording system according to claim 3, wherein one of the recording device and the drying device includes the first setting member;

the first setting member includes a first contacting part configured to make contact with the other of the recording device and the drying device;

the other of the recording device and the drying device includes a first contacted part configured to be brought into contact with the first contacting part;

one of the recording device and the drying device includes the second setting member;

the second setting member includes a second contacting part configured to make contact with the other of the recording device and the drying device;

the other of the recording device and the drying device includes a second contacted part configured to be brought into contact with the second contacting part;

the first spacing is set to a predetermined spacing by the first contacting part making contact with the first contacted part; and the second spacing is set to a predetermined spacing by the second contacting part making contact with the second contacted part.

5. The recording system according to claim 4, wherein the recording system includes:

a first detection unit configured to detect contact between the first contacting part and the first contacted part; and a second detection unit configured to detect contact between the second contacting part and the second contacted part.

6. The recording system according to claim 4, wherein the first contacting part includes a first electrically-coupling unit configured to be electrically coupled with the first contacted part;

the first contacted part includes a first electrically-coupled unit configured to be electrically coupled with the first contacting part;

the second contacting part includes a second electrically-coupling unit configured to be electrically coupled with the second contacted part;

the second contacted part includes a second electrically-coupled unit configured to be electrically coupled with the second contacting part;

the first electrically-coupling unit is electrically coupled with the first electrically-coupled unit through contact between the first contacting part and the first contacted part; and the second electrically-coupling unit is electrically coupled with the second electrically-coupled unit through contact between the second contacting part and the second contacted part.

7. The recording system according to claim 4, wherein the recording system includes a first detection unit configured to detect contact between the first contacting part and the first contacted part;

the second contacting part includes a second electrically-coupling unit configured to be electrically coupled with the second contacted part;

the second contacted part includes a second electrically-coupled unit configured to be electrically coupled with the second electrically-coupling unit; and the second electrically-coupling unit is electrically coupled with the second electrically-coupled unit through contact between the second contacting part and the second contacted part.

8. The recording system according to claim 1, wherein the recording device and the drying device are installed on a same plane;

the support surface extends in a direction that intersects the plane; and the drying device is mounted on the recording device from a direction parallel to the plane by moving the drying device on the plane.

9. The recording system according to claim 1, wherein the recording device includes a control unit configured to control the recording system;

the control unit causes the drying mechanism to function when the spacing is set to a predetermined spacing by the setting member; and the control unit stops the function of the drying mechanism when the setting by the setting member is released.

10. The recording system according to claim 1, wherein the drying device includes a power source unit configured to supply power to the drying mechanism.

11. The recording system according to claim 1, wherein the setting member is configured such that a posture is switchable between a first posture and a second posture, the first posture setting the spacing to a predetermined spacing, the second posture causing a footprint of the setting member to be smaller than the first posture.

12. A drying device configured to be mounted on a recording device, the recording device including a recording unit configured to perform recording by applying liquid to a recording medium conveyed in a conveyance direction, and a support surface configured to support the recording medium downstream in the conveyance direction, the drying device comprising a drying mechanism configured to dry the recording medium, to which the liquid is applied, at a position facing the support surface when the drying device is mounted on the recording device, wherein the drying device includes a setting member configured to set a spacing between the support surface and the drying mechanism to a predetermined spacing;

the drying mechanism functions when the spacing is set to the predetermined spacing by the setting member; and a function of the drying mechanism stops when the setting by the setting member is released.

* * * * *